US010891835B2

(12) United States Patent
Mochizuki

(10) Patent No.: US 10,891,835 B2
(45) **Date of Patent: *Jan. 12, 2021**

(54) CASH STORAGE APPARATUS

(71) Applicant: CASIO COMPUTER CO., LTD., Tokyo (JP)

(72) Inventor: Yoshiaki Mochizuki, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 46 days.

This patent is subject to a terminal disclaimer.

(21) Appl. No.: 16/274,316

(22) Filed: Feb. 13, 2019

(65) Prior Publication Data

US 2019/0251798 A1 Aug. 15, 2019

(30) Foreign Application Priority Data

Feb. 15, 2018 (JP) ..... 2018-025107

(51) Int. Cl.

| | |
|---|---|
| ***G07G 1/00*** | (2006.01) |
| ***G07G 1/12*** | (2006.01) |
| ***G07G 5/00*** | (2006.01) |
| ***G07F 9/06*** | (2006.01) |

(52) U.S. Cl.

CPC ..... *G07G 1/0027* (2013.01); *G07F 9/06* (2013.01); *G07G 1/12* (2013.01); *G07G 5/00* (2013.01)

(58) Field of Classification Search

CPC ... G07G 1/0027; E05B 65/461; E05B 65/462; G07D 11/125; G07D 11/009; G07D 11/0096

USPC ..... 235/22; 109/45, 53

See application file for complete search history.

(56) References Cited

U.S. PATENT DOCUMENTS

| | | | | |
|---|---|---|---|---|
| 6,929,178 | B2 | 8/2005 | Moriya et al. | |
| 10,540,862 | B2 * | 1/2020 | Mochizuki | E05B 65/0075 |
| 2003/0116618 | A1 | 6/2003 | Moriya et al. | |
| 2010/0180804 | A1 * | 7/2010 | Czarnecki | A45C 1/10 109/45 |
| 2016/0253646 | A1 | 9/2016 | Shinmura et al. | |

FOREIGN PATENT DOCUMENTS

| | | | |
|---|---|---|---|
| JP | S62-96790 | U | 6/1987 |
| JP | H08-305957 | A | 11/1996 |
| JP | H09-16853 | A | 1/1997 |

(Continued)

OTHER PUBLICATIONS

U.S. Appl. No. 16/274,322, filed Feb. 13, 2019.

Extended European Search Report dated Sep. 20, 2019 received in European Patent Application No. EP 19157053.0.

*Primary Examiner* — Suezu Ellis

(74) *Attorney, Agent, or Firm* — Scully Scott Murphy & Presser

(57) ABSTRACT

A cash storage apparatus of which a housing is structured such that a length in a depth direction is longer than a length in a height direction in a horizontal orientation state where a surface from which a cash storage case is pulled out or pushed out serves as a front surface, and in which a portion of an upper surface or undersurface of the housing when the housing is in the horizontal orientation state serves as an open/close cover that is opened frontward, in order to enable use in a vertical orientation state where the front surface when the housing is in the horizontal orientation state serves as an upper surface.

10 Claims, 14 Drawing Sheets

(56) References Cited

FOREIGN PATENT DOCUMENTS

| | | | |
|---|---|---|---|
| JP | 2003-196740 | A | 7/2003 |
| JP | 2014-052668 | A | 3/2014 |
| JP | 2015-060368 | A | 3/2015 |
| JP | 2017-097396 | A | 6/2017 |
| JP | 2017-152062 | A | 8/2017 |

* cited by examiner

CASH STORAGE APPARATUS

CROSS-REFERENCE TO RELATED APPLICATION

This application is based upon and claims the benefit of priority from the prior Japanese Patent Application No. 2018-025107, filed Feb. 15, 2018, the entire contents of which are incorporated herein by reference.

BACKGROUND OF THE INVENTION

1. Field of the Invention

The present invention relates to a cash storage apparatus for use in an electronic register.

2. Description of the Related Art

For example, a cash storage apparatus is known which has a structure where a cash storage case is accommodated within a housing and which can be pulled out, as described in Japanese Patent Application Laid-Open (Kokai) Publication No. 2003-196740.

SUMMARY OF THE INVENTION

In accordance with one aspect of the present invention, there is provided a cash storage apparatus whose housing is structured such that, in a horizontal orientation state where a surface from which a cash storage case is pulled out or pushed out serves as a front surface, a length in a depth direction is longer than a length in a height direction, wherein a portion of an upper surface or undersurface of the housing when the housing is in the horizontal orientation state serves as an open/close cover that is opened frontward, in order to enable use in a vertical orientation state where the front surface when the housing is in the horizontal orientation state serves as an upper surface.

In accordance with another aspect of the present invention, there is provided a cash storage apparatus of which a housing is structured such that a length in a depth direction is longer than a length in a height direction in a horizontal orientation state where a surface from which a cash storage case is pulled out or pushed out serves as a front surface, and in which a receipt is ejected from a receipt ejection slot with a printing surface being oriented upward, wherein a portion of an upper surface or undersurface of the housing when the housing is in the horizontal orientation state serves as an open/close cover that is opened frontward, in order to enable use in a vertical orientation state where the printing surface of the receipt to be ejected from the receipt ejection slot is oriented frontward.

In accordance with another aspect of the present invention, there is provided a cash storage apparatus whose housing is structured such that, in a horizontal orientation state where a surface from which a cash storage case is pulled out or pushed out serves as a front surface, a length in a depth direction is longer than a length in a height direction, wherein a leg for vertical orientation is provided to be positioned on a back surface of the housing when the housing is in the horizontal orientation state, in order to enable use in a vertical orientation state where the front surface when the housing is in the horizontal orientation state serves as an upper surface.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 8A and FIG. 8B are diagrams each showing the inner structure of the cash storage apparatus of FIG. 1 in the vertical orientation state, of which FIG. 8A is a sectional view when the open/close cover is closed and FIG. 8B is a sectional view when the open/close cover is open;

FIG. 11A and FIG. 11B are sectional views of a second lock section of the lock mechanism taken along line A-A in FIG. 9, of which FIG. 11A is a sectional view when the open/close cover is locked by the second lock section and FIG. 11B is a sectional view when the locking of the open/close cover by the second lock section is released;

FIG. 12A, FIG. 12B and FIG. 12C are diagrams each showing the open/close mechanism shown in FIG. 9, of which FIG. 12A shows a home position of the open/close mechanism when the cash storage case and the open/close cover have been locked by the lock mechanism, FIG. 12B shows a first release position of the open/close mechanism when the locking of the cash storage case by the first lock section of the lock mechanism has been released, and FIG. 12C shows a second release position of the open/close mechanism when the locking of the open/close cover by the second lock section of the lock mechanism has been released;

FIG. 13A and FIG. 13B are diagrams each showing the cash storage apparatus of FIG. 1 in the vertical orientation state, of which FIG. 13A is a perspective view of the structure of a stand provided to the open/close cover of the cash storage apparatus and FIG. 13B is a perspective view of leg portions when the cash storage apparatus in the vertical orientation state is viewed from diagonally below; and FIG. 14A and FIG. 14B are diagrams each showing a modification example of the stand shown in FIG. 13A, of which FIG. 14A is a perspective view of a first modification example of the stand and FIG. 14B is a perspective view of a second modification example of the stand.

DETAILED DESCRIPTION OF THE PREFERRED EMBODIMENTS

An embodiment of an electronic register in which the present invention has been applied will hereinafter be described with reference to FIG. 1 to FIG. 13B.

This electronic register includes a cash storage apparatus 1 and a tablet terminal 2, and data transmission or reception is performed therebetween via wireless communication. The cash storage apparatus 1 is structured to be installed in a horizontal orientation state for horizontal orientation installation or in a vertical orientation state for vertical orientation installation.

Figure 1:
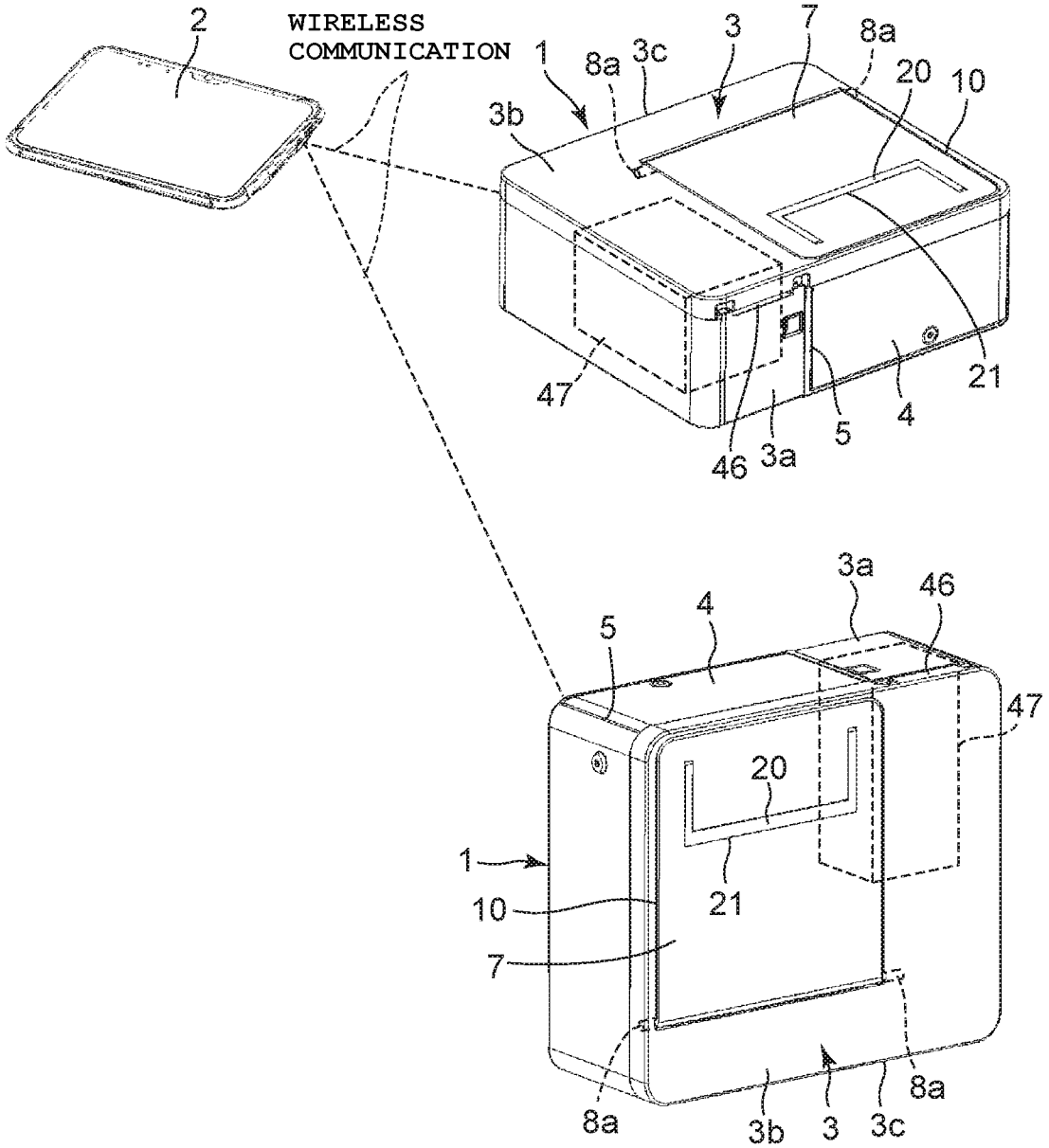
FIG. 1 is a structural diagram of an embodiment to which the present invention has been applied in an electronic register.
Figure 2:
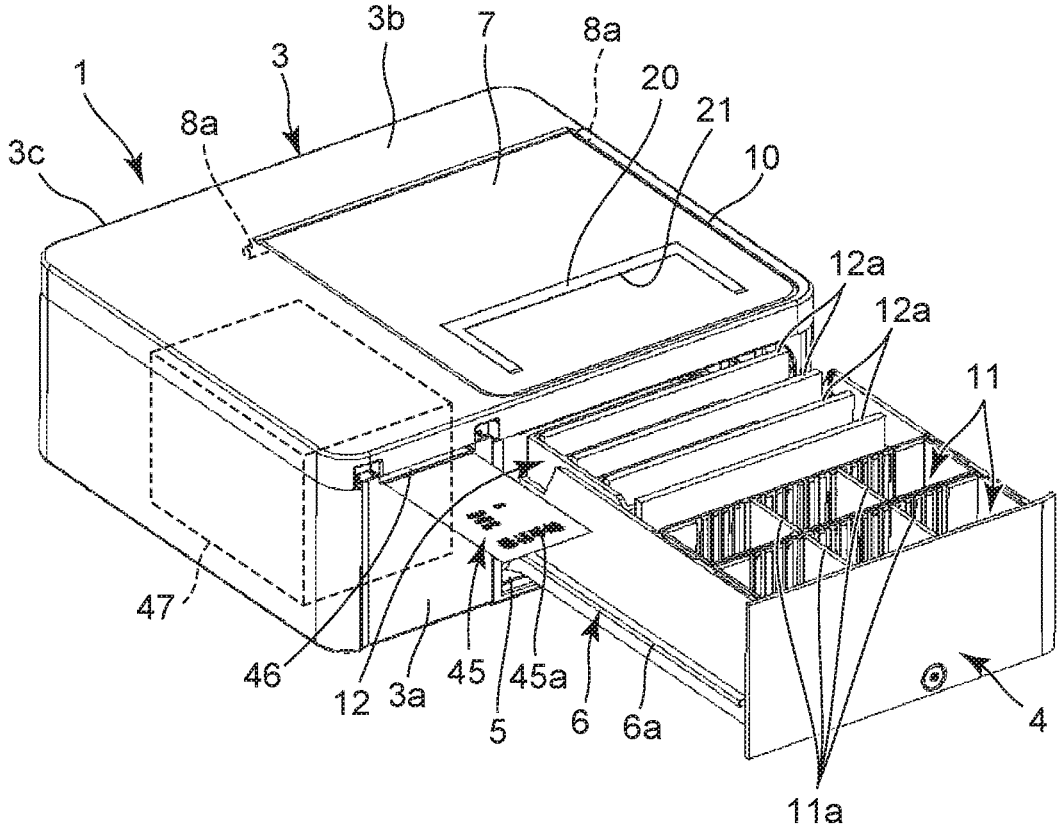
FIG. 2 is a perspective view of a cash storage apparatus shown in FIG. 1, in which the cash storage apparatus has been placed in a horizontal orientation state with its cash storage case being pulled out.
Figure 3:
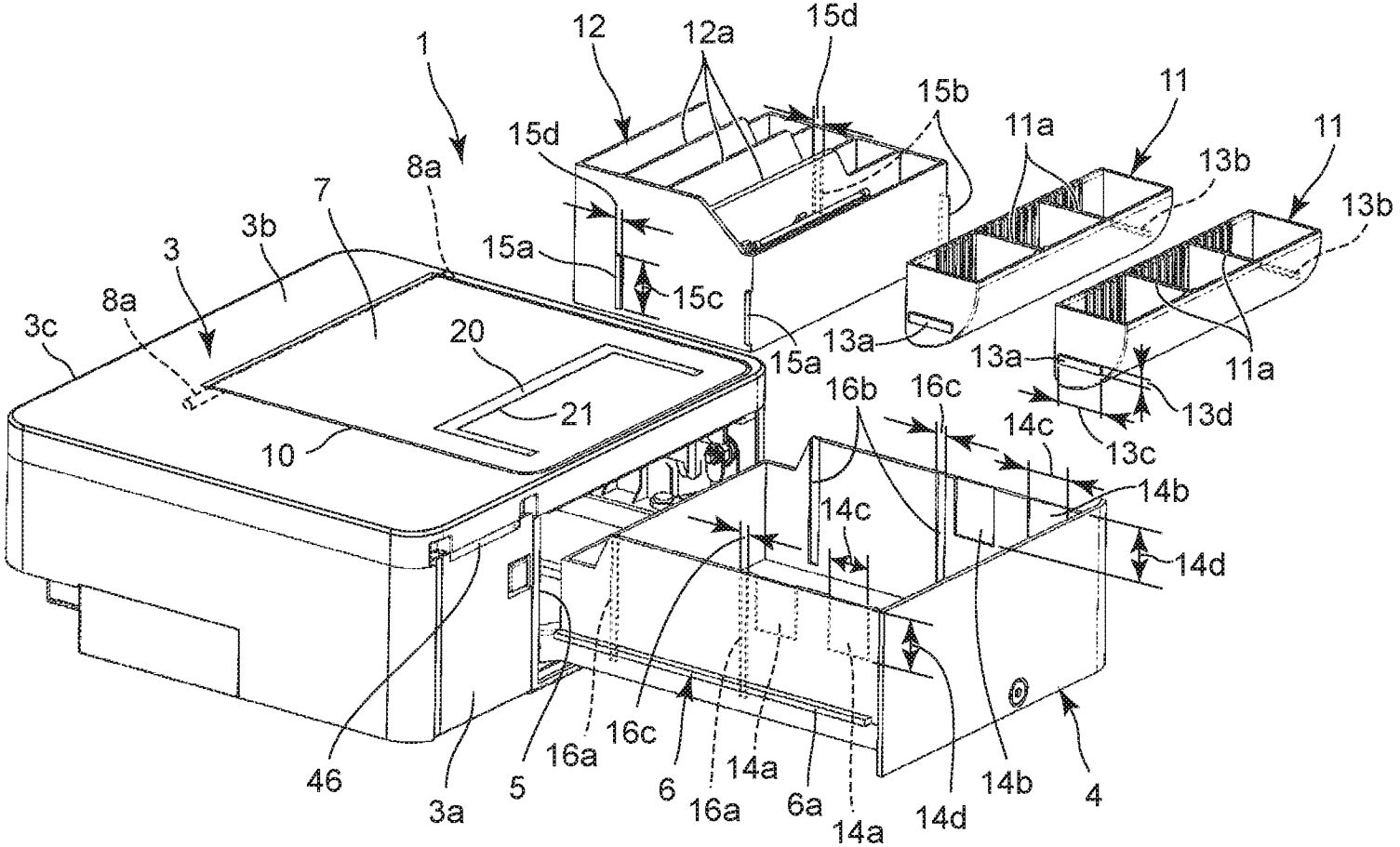
FIG. 3 is a perspective view of the cash storage case of FIG. 2 in a disassembled state.

More specifically, the cash storage apparatus 1 includes a housing 3 as shown in FIG. 1 to FIG. 3. This housing 3 is structured such that a cash storage case 4 stored within can be pulled out when the cash storage apparatus 1 is in the horizontal orientation state. That is, this housing 3 is structured such that its length in the depth direction is longer than its length in the height direction when the cash storage apparatus 1 is installed in the horizontal orientation state with a surface where the cash storage case 4 is pulled out or pushed out as a front surface 3*a*.

Also, this housing 3 is formed such that, in the horizontal orientation state, its length in the depth direction is longer than its length in the height direction, and its length in the width direction of the front surface 3*a* orthogonal to the depth direction is longer than its length in the height direction, as shown in FIG. 1 to FIG. 3. Also, on the front surface 3*a* of this housing 3, a case opening 5 into which the cash storage case 4 is inserted or from which the cash storage case 4 is pulled out in the horizontal orientation state is provided on the right side, that is, on the front surface 3*a* excluding a left side portion.

The cash storage case 4 has a box shape formed such that its front surface, which corresponds to the front surface 3*a* of the housing 3 when the cash storage case 4 is housed in the housing 3, is equal in size to the case opening 5, its width when the housing 3 is in the horizontal orientation state is shorter than the width of the front surface 3*a* of the housing 3, its height is slightly lower than the height of the housing 3, and its depth is shorter than the depth of the housing 3, as shown in FIG. 1 to FIG. 3. Also, this cash storage case 4 is formed such that its upper surface side is exposed when the housing 3 is in the horizontal orientation state.

Also, this cash storage case 4 is structured to be slidably stored in the housing 3 by a sliding mechanism 6, as shown in FIG. 1 to FIG. 3. This slide mechanism 6 includes case guide rails 6*a* provided on both side portions of the cash storage case 4 and housing guide rails and guide rollers (both are not shown) provided on the housing 3 so as to guide the case guide rails 6*a* of the cash storage case 4, and causes the cash storage case 4 to be slid in the pull-out direction.

Also, in order to enable the use in the vertical orientation state where the front surface 3*a* in the horizontal orientation state serves as an upper surface, the housing 3 has an open/close cover 7 that is opened frontward. This open/close cover 7 is provided such that it is openable and closable by a rotation mechanism 8 and is positioned on a part of an upper surface 3*b* when the housing 3 is in the horizontal orientation state, as shown in FIG. 1 and FIG. 5 to FIG. 7.

The slide mechanism 6 is structured to allow the cash storage case 4 to be moved from a first position where its open upper surface is covered by the open/close cover 7, that is, a position where the cash storage case 4 is housed in the housing 3 to a second position where its open upper surface is released from the open/close cover 7, that is, a position where the cash storage case 4 is pulled out from the housing 3, as shown in FIG. 2.

The upper surface 3*b* of this housing 3 in the horizontal orientation state has a cover opening section 10 which corresponds to the open surface on the upper surface side of the cash storage case 4 housed in the housing 3, as shown in FIG. 1 and FIG. 5 to FIG. 7. This cover opening section 10 is provided to be positioned in a right front area on the upper surface 3*b* of the housing 3, that is, an area excluding a left side portion and a far side portion when the front surface 3*a* of the housing 3 in the horizontal orientation state is oriented to the front side. The open/close cover 7 is structured to have the same size as that of the cover opening section 10 so as to cover the cash storage case 4 housed in the housing 3 and openably close the cover opening section 10.

Figure 6:
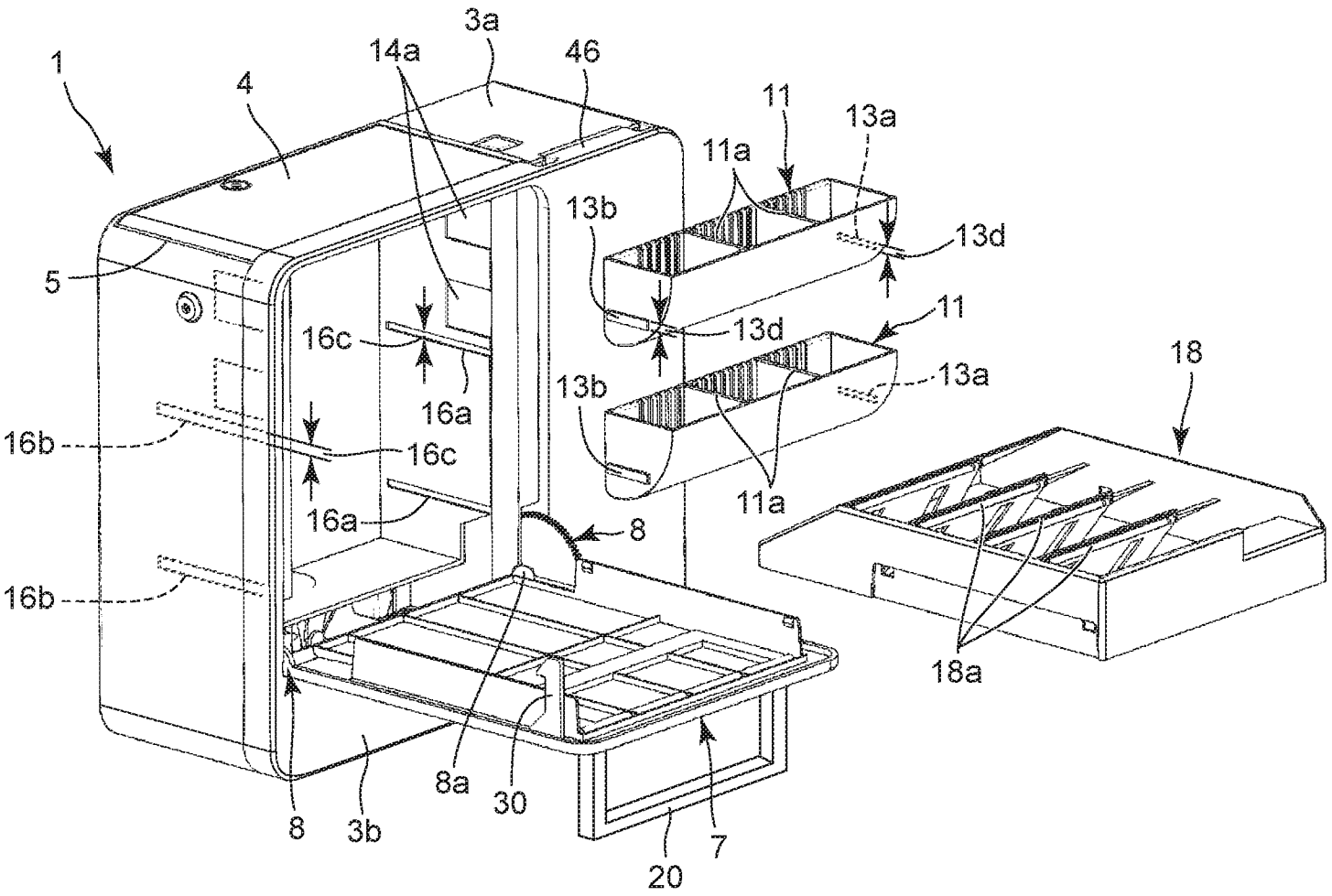
FIG. 6 is an exploded perspective view of the cash storage case of FIG. 5 in the vertical orientation state.
Figure 7:
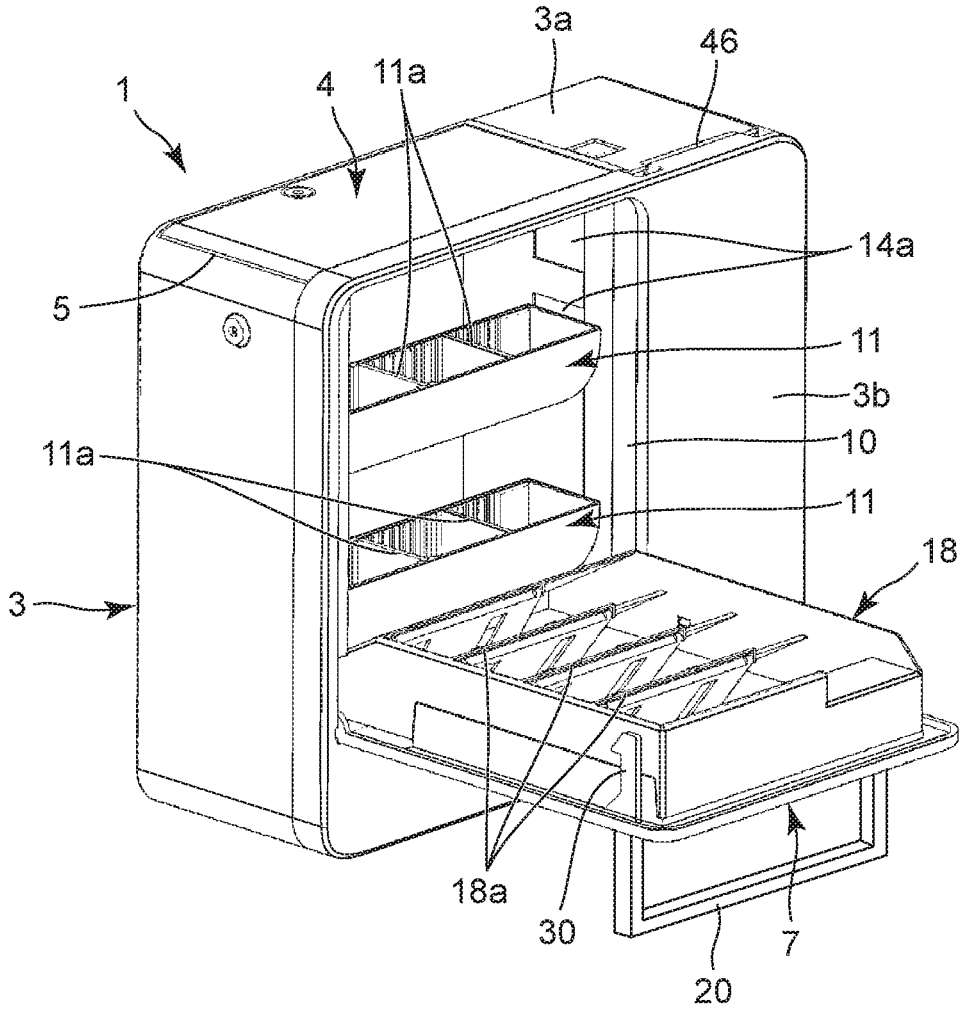
FIG. 7 is a perspective view of the cash storage case of FIG. 5 in the vertical orientation state, in which the coin boxes have been slid toward a cover opening section on a front side.

The rotation mechanism 8 includes a rotation shaft 8*a* provided on the far side of the open/close cover 7 in the depth direction of the housing 3 in the horizontal orientation state, as shown in FIG. 1 and FIG. 6. The end portions of this rotation shaft 8*a* are rotatably attached on the upper surface 3*b* side of the housing 3 in a manner to be positioned on the far side of the cover opening section 10. As a result, the open/close cover 7 rotates around the rotation shaft 8*a* of the rotation mechanism 8 in a vertical direction to openably close the cover opening section 10.

That is, this rotation mechanism 8 is structured such that, in the vertical orientation state where the front surface 3*a* of the housing 3 in the horizontal orientation state serves as an upper surface and the upper surface 3*b* of the housing 3 in the horizontal orientation state serves as a front surface, the far side of the cover opening section 10 in the horizontal orientation state serves as a lower side and the rotation shaft 8*a* is positioned on this lower side, as shown in FIG. 1 and FIG. 6. That is, the rotation mechanism 8 is structured such that, when the housing 3 is in the vertical orientation state, the open/close cover 7 is rotated around the rotation shaft 8*a* toward the front side and thereby exposes the cover opening section 10.

The cash storage case 4 is formed in a box shape whose upper side is open as a cash insertion opening when the housing 3 is in the horizontal orientation state, as shown in FIG. 2 and FIG. 3. This cash storage case 4 is structured such that a plurality of coin boxes 11 and a first bill box 12 are removably housed therein. The coin boxes 11 are cases in which coins are put by type, and the upper surface side of each box is open as a coin insertion opening. The first bill box 12 is a case in which bills are put by type, and its upper surface side is open as a bill insertion opening.

Also, when the housing 3 is in the horizontal orientation state, the length of each coin box 11 in its width direction orthogonal to the front-and-back direction of the cash storage case 4 serving as the pull-out direction, that is, the slide direction is substantially equal to that of the cash storage case 4, as shown in FIG. 2 and FIG. 3. Also, the length of each coin box 11 in the front-and-back direction of the cash storage case 4 serving as the pull-out direction, that is, the slide direction is as short as about ¼ of the length of the cash storage case 4 in the front-and-back direction. Moreover, the height (depth) of each coin box 11 in the vertical direction is as short (shallow) as about half of the height (depth) of the cash storage case 4. As a result, each coin box 11 has a substantially box shape.

That is, when the housing 3 is in the horizontal orientation state, these coin boxes 11 are arranged in a horizontal orientation attachment state that is a first attachment state in which the coin boxes 11 are aligned in the front-and-back direction of the cash storage case 4 serving as the pull-out direction, that is, the slide direction on the inner front side of the cash storage case 4, as shown in FIG. 2 and FIG. 3.

Also, these coin boxes 11 are each formed such that its lower part on the front surface side of the cash storage case 4 when the housing 3 is in the horizontal orientation state has an arc-shaped curved surface, as shown in FIG. 2 and FIG. 3. Note that the present invention is not limited thereto and each coin box 11 may have a box shape such as a rectangular parallelepiped shape whose bottom surface is a flat surface. The inside of each coin box 11 is partitioned by types of coins by a plurality of partition boards 11*a*.

Each of the plurality of coin boxes 11 is provided with a pair of engagement projections 13*a* and 13*b* on both side surfaces in the width direction orthogonal to the front-and-back direction of the cash storage case 4 serving as the pull-out direction when the housing 3 is in the horizontal orientation state, as shown in FIG. 3. This pair of engagement projections 13*a* and 13*b* is structured to be slid and inserted from above into a pair of first attachment grooves 14*a* and 14*b* provided opposing each other in both side surfaces in the cash storage case 4 when the housing 3 is in the horizontal orientation state, and thereby restrict the position of the coin box 11 in the cash storage case 4 for arrangement.

Each of the pair of engagement projections 13*a* and 13*b* is formed in a rectangular bar shape whose length in the front-and-back direction of the coin box 11 that is the pull-out direction of the cash storage case 4 when the housing 3 is in the horizontal orientation state is longer than its length in the height direction, as shown in FIG. 3. That is, the width 13*c* of each of the engagement projections 13*a* and 13*b* in the front-and-back direction of the coin box 11 that is the pull-out direction of the cash storage case 4 is longer than its thickness 13*d* in the vertical direction of the coin box 11 that is the height direction of the cash storage case 4.

Also, the groove width 14*c* of each of the first attachment grooves 14*a* and 14*b* in the cash storage case 4 in the front-and-back direction that is the pull-out direction of the cash storage case 4 when the housing 3 is in the horizontal orientation state is equal to the width 13*c* of each of the engagement projections 13*a* and 13*b* on each coin box 11 in the front-and-back direction, and its height 14*d* in the vertical direction is equal to the height of each of the engagement projections 13*a* and 13*b* in the vertical direction of the coin box 11, that is, the height from the upper end of the coin box 11 to each of the engagement projections 13*a* and 13*b*, as shown in FIG. 3.

As a result, when the housing 3 is in the horizontal orientation state, if the pair of engagement projections 13*a* and 13*b* of each coin box 11 is slid and inserted from above into the corresponding pair of first attachment grooves 14*a* and 14*b* in the cash storage case 4, the coin box 11 is arranged in the cash storage case 4 with the upper end of the coin box 11 and the upper end of the cash storage case 4 being substantially equal in height to each other, as shown in FIG. 2 and FIG. 3. In this embodiment, two pairs of first attachment grooves 14*a* and 14*b* are provided in a manner to be aligned in the front-and-back direction in a substantially half area on the front side of the cash storage case 4.

Also, regarding each pair of engagement projections 13*a* and 13*b* on both side surfaces in the direction orthogonal to the front-and-back direction of the coin box 11 that is the pull-out direction of the cash storage case 4, their widths 13*c* in the front-and-back direction are different from each other and their thicknesses 13*d* in the vertical direction are also different from each other, as shown in FIG. 3. That is, the vertical thickness 13*d* of one engagement projection 13*a* provided on one of the side surfaces of the coin box 11 such as the left side surface is thicker than the vertical thickness 13*d* of the other engagement projection 13*b* provided on the other side surface of the coin box 11 such as the right side surface.

Also, for one engagement projection 13*a* provided on one of the side surfaces of the coin box 11 such as the left side surface, the width 13*c* in the front-and-back direction of the coin box 11 that is the pull-out direction of the cash storage case 4 is formed longer than that of the other engagement projection 13*b* provided on the other side surface of the coin box 11 such as the right side surface.

Accordingly, the left first attachment grooves 14*a* and the right first attachment grooves 14*b* in the side surfaces in the cash storage case 4 have different groove widths 14*c* extending in the front-and-back direction that is the pull-out direction, as shown in FIG. 3. That is, the groove width 14*c* of one first attachment groove 14*a* provided in one of the side surfaces in the cash storage case 4 such as the left inner side surface is longer than the groove width 14*c* of the other first attachment groove 14*b* provided in the other side surface such as the right inner side surface.

Also, the vertical length of one first attachment groove 14*a* provided in one of the side surfaces in the cash storage case 4 such as the left inner side surface is equal to the vertical length of the other first attachment groove 14*b* provided in the other side surface such as the right inner side surface, as shown in FIG. 3.

As a result, in the coin box 11, when one engagement projection 13*a* provided on the left side surface that is one of the side surfaces is positioned corresponding to one first attachment groove 14*a* provided in the left inner side surface that is one of the side surfaces in the cash storage case 4, and the other engagement projection 13*b* provided on the right side surface that is the other side surface is positioned corresponding to the other first attachment groove 14*b* provided in the right inner side surface that is the other side surface in the cash storage case 4, the pair of left and right engagement projections 13*a* and 13*b* can be respectively inserted into the pair of first attachment grooves 14*a* and 14*b* in the cash storage case 4, as shown in FIG. 3.

Accordingly, when the pair of left and right engagement projections 13*a* and 13*b* of each coin box 11 is inserted into the corresponding pair of first attachment grooves 14*a* and 14*b* in the cash storage case 4, they are arranged in the horizontal orientation state that is the first attachment state in which the upper end of the coin box 11 and the upper end of the cash storage case 4 are positioned at the same height and the curved surface of the coin box 11 is oriented toward the front surface side, as shown in FIG. 3.

Also, the coin box 11 is structured such that, even if one engagement projection 13*a* provided on the left side surface that is one of the side surfaces is positioned corresponding to one first attachment groove 14*b* provided in the right inner side surface that is one of the side surfaces in the cash storage case 4, and the other engagement projection 13*b* provided on the right side surface that is the other side surface of the coin box 11 is positioned corresponding to the other first attachment groove 14*a* provided in the left inner side surface that is one of the side surfaces in the cash storage case 4, the pair of left and right engagement projections 13*a* and 13*b* cannot be inserted into the pair of first attachment grooves 14*a* and 14*b* in the cash storage case 4, as shown in FIG. 3.

That is, the pair of left and right engagement projections 13*a* and 13*b* of each coin box 11 and the corresponding pair of first attachment grooves 14*a* and 14*b* in the cash storage case 4 form a front-and-back position restriction section which restricts the orientation of the coin box 11 in the cash storage case 4 in the front-and-back direction, as shown in FIG. 2 and FIG. 3. As a result of this structure, by each pair of left and right engagement projections 13*a* and 13*b* and the corresponding pair of first attachment grooves 14*a* and 14*b* in the cash storage case 4, each coin box 11 is prevented from being wrongly oriented in terms of the front-and-back direction when it is arranged in the cash storage case 4.

On the other hand, the first bill box 12 is structured to be arranged on the back side, or in other words, the far side of the cash storage case 4 in the front-and-back direction that is the pull-out direction when the housing 3 is in the horizontal orientation state. That is, this first bill box 12 is formed such that its length in the width direction orthogonal to the front-and-back direction of the cash storage case 4 that is the pull-out direction is equal to that of the cash storage case 4, its length in the front-and-back direction of the cash storage case 4 that is the pull-out direction is as short as about half of the length of the cash storage case 4 in the front-and-back direction, and its height (depth) is equal to the height (depth) of the cash storage case 4, and thereby has a substantially box shape, as shown in FIG. 2 and FIG. 3.

The inside of this first bill box 12 is partitioned by a plurality of partition boards 12*a* by types of bills, as shown in FIG. 2 and FIG. 3. Each partition board 12*a* is provided inside the first bill box 12 in a manner to stand at an angle nearly perpendicular to the bottom surface of the first bill box 12, that is, at an inclination angle by which it is slightly inclined toward the front side of the first bill box 12 with respect to the bottom surface, when the housing 3 is in the horizontal orientation state. As a result of this structure, bills are put in the first bill box 12 by type by the plurality of partition boards 12*a* and stand at a nearly perpendicular angle.

Also, this first bill box 12 has pairs of front and back restriction projections 15*a* and 15*b* provided on both side surfaces located in the width direction orthogonal to the front-and-back direction of the cash storage case 4 that is the pull-out direction when the housing 3 is in the horizontal orientation state, as shown in FIG. 2 and FIG. 3. Each pair of restriction projections 15*a* and 15*b* is structured to be slid and inserted into a pair of front and back second attachment grooves 16*a* and 16*b* provided in both side surfaces located in the width direction in the cash storage case 4 when the housing 3 is in the horizontal orientation state, and thereby restricts the orientation of the first bill box 12 in the front-and-back direction so as to arrange the first bill box 12 in the cash storage case 4.

That is, each of the restriction projections 15*a* and 15*b* is formed such that its height 15*c* in the vertical direction of the first bill box 12 when the housing 3 is in the horizontal orientation state is longer than its width 15*d* in the front-and-back direction of the first bill box 12 that is the pull-out direction of the cash storage case 4, and thereby has a rectangular bar shape, as shown in FIG. 3. That is, each of the restriction projections 15*a* and 15*b* is formed such that its height 15*c* in the vertical direction of the first bill box 12 that is the height direction of the cash storage case 4 is longer than its width 15*d* in the front-and-back direction of the first bill box 12 that is the pull-out direction of the cash storage case 4.

Also, each of the front and back second attachment grooves 16*a* and 16*b* of the cash storage case 4 is formed such that its groove width 16*c* in the front-and-back direction that is the pull-out direction of the cash storage case 4 when the housing 3 is in the horizontal orientation state is equal to the width 15*d* of each of the restriction projections 15*a* and 15*b* in the front-and-back direction of the first bill box 12 that is the pull-out direction of the cash storage case 4. Each of these front and back second attachment grooves 16*a* and 16*b* is provided extending from the upper end of the cash storage case 4 to the lower end, as shown in FIG. 3.

As a result, when the housing 3 is in the horizontal orientation state, if each pair of front and back restriction projections 15*a* and 15*b* of the first bill box 12 is slid and inserted from above into the corresponding pair of front and back second attachment grooves 16*a* and 16*b* in the cash storage case 4, and the under surface of the first bill box 12 comes in contact with the bottom surface of the cash storage case 4, the first bill box 12 is arranged in the cash storage case 4 with the upper end of the first bill box 12 and the upper end of the cash storage case 4 being substantially equal in height to each other, as shown in FIG. 2 and FIG. 3.

Here, two pairs of front and back second attachment grooves 16*a* and 16*b* have been provided and each pair has been aligned in the front-and-back direction, in a substantially half area on the far side of the cash storage case 4, as shown in FIG. 3. Also, the left pair of front and back restriction projections 15*a* and the right pair of front and back restriction projections 15*b* on the first bill box 12 have different widths 15*d* in the front-and-back direction that is the pull-out direction of the cash storage case 4.

That is, the horizontal width 15*d* of each of the front and back restriction projections 15*a* provided on one side surface of the first bill box 12 in the width direction, such as the left side surface, is longer (wider) than the horizontal width 15*d* of each of the front and back restriction projections 15*b* provided on the other side surface of the first bill box 12 such as the right side surface.

Accordingly, the left pair of front and back second attachment grooves 16*a* and the right pair of front and back second attachment grooves 16*b* in the side surfaces in the cash storage case 4 have different groove widths 16*c* in the front-and-back direction, as shown in FIG. 3. That is, the horizontal groove width 16*c* of each of the front and back second attachment grooves 16*a* provided in one of the side surfaces in the cash storage case 4, such as the left inner side surface, is longer (wider) than the horizontal groove width 16*c* of each of the front and second attachment grooves 16*b* provided in the other side surface such as the right inner side surface.

As a result, when the front and back restriction projections 15*a* provided on the left side surface that is one of the side surfaces of the first bill box 12 are positioned corresponding to the front and back second attachment grooves 16*a* provided in the left inner side surface that is one of the side surfaces of the cash storage case 4, and the front and back restriction projections 15*b* provided on the right side surface that is the other side surface are positioned corresponding to the front and back second attachment grooves 16*b* provided in the right inner side surface that is the other side surface of the cash storage case 4, the restriction projections 15*a* and

15*b* can be respectively inserted into the second attachment grooves 16*a* and 16*b* of the cash storage case 4, as shown in FIG. 3.

Also, when the front and back restriction projections 15*a* provided on the left side surface that is one of the side surfaces of the first bill box 12 are positioned corresponding to the front and back second attachment grooves 16*b* provided in the right inner side surface that is one of the side surfaces of the cash storage case 4 and the front and back restriction projections 15*b* provided on the right side surface that is the other side surface of the first bill box 12 are positioned corresponding to the front and back second attachment grooves 16*a* provided in the left inner side surface that is the other side surface of the case storage case 4, the restriction projections 15*a* and 15*b* cannot be inserted into the second attachment grooves 16*a* and 16*b* of the cash storage case 4, as shown in FIG. 3.

Accordingly, when the front and back restriction projections 15*a* and 15*b* are positioned corresponding to and inserted into the front and back second attachment grooves 16*a* and 16*b* of the cash storage case 4, the first bill box 12 is arranged in the cash storage case 4 with its upper end being positioned at the same height as the upper end of the cash storage case 4 by its undersurface being in contact with the bottom surface of the cash storage case 4, whereby the orientation of the first bill box 12 is restricted, as shown in FIG. 2 and FIG. 3.

That is, the front and back restriction projections 15*a* and 15*b* of the first bill box 12 and the front and back second attachment grooves 16*a* and 16*b* in the cash storage case 4 form a front-and-back position restriction section which restricts the orientation of the first bill box 12 in the front-and-back direction when it is arranged in the cash storage case 4, as shown in FIG. 2 and FIG. 3. As a result of this structure, by the front and back restriction projections 15*a* and 15*b* and the front and back second attachment grooves 16*a* and 16*b* in the cash storage case 4, the first bill box 12 is prevented from being wrongly oriented in terms of the front-and-back direction when it is arranged in the cash storage case 4.

Also, the width 15*d* of each of the front and back restriction projections 15*a* and 15*b* of the first bill box 12 and the groove width 16*c* of each of the front and back second attachment grooves 16*a* and 16*b* in the cash storage case 4 are formed to be equal to the vertical thickness 13*d* of each of the engagement projections 13*a* and 13*b* provided on the left and right side surfaces of the coin box 11, as shown in FIG. 2 and FIG. 3.

Figure 4:
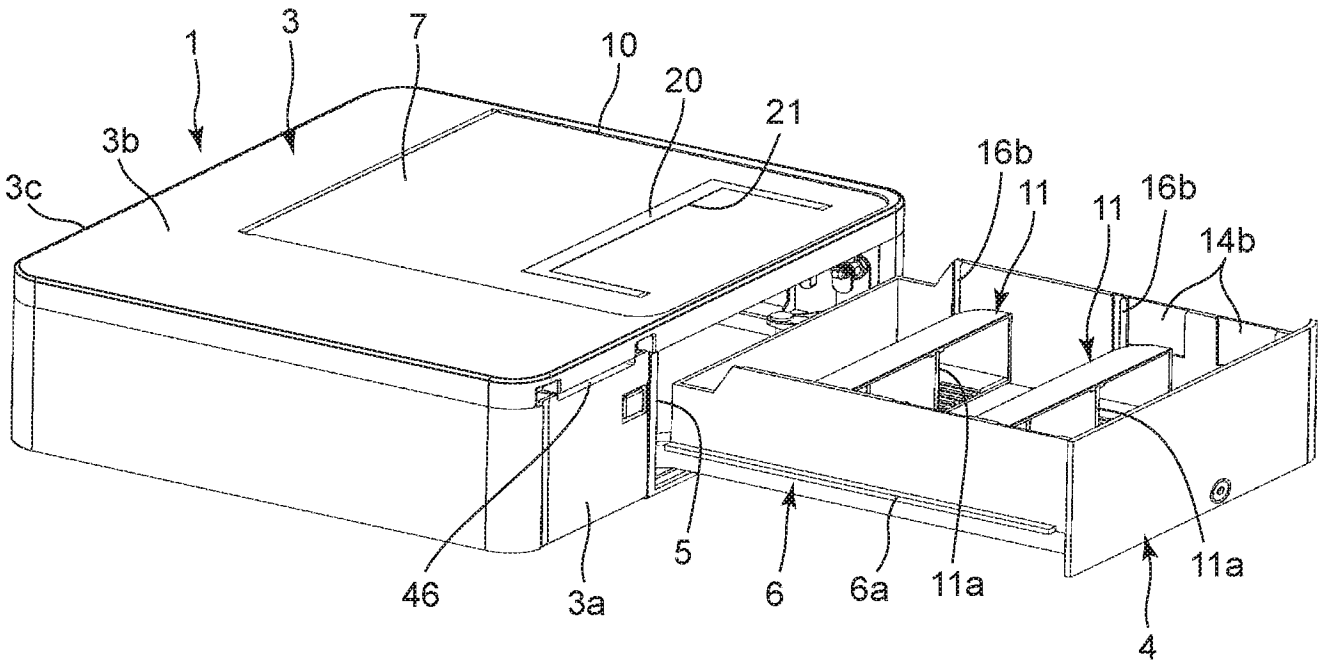
FIG. 4 is a perspective view of the cash storage apparatus of FIG. 2 in the horizontal orientation state, in which coin boxes have been arranged in the pulled-out cash storage case in a manner to be usable in a vertical orientation state.

Accordingly, after the first bill box 12 is removed from the inside of the cash storage case 4, each coin box 11 can be arranged at the position where the first bill box 12 had been arranged, in a laterally-oriented attachment state that is a second attachment state where the coin insertion opening on the open side of each coin box 11 has been oriented toward the front side surface of the cash storage case 4, as shown in FIG. 3 and FIG. 4.

That is, by the pair of engagement projections 13*a* and 13*b* of each coin box 11 being slid and inserted from above into the corresponding pair of front and back second attachment grooves 16*a* and 16*b* in the cash storage case 4 with the coin insertion opening on the open side being laterally oriented, each coin box 11 in the laterally-oriented attachment state that is the second attachment state can be arranged at the position where the first bill box 12 had been arranged in the cash storage case 4, as shown in FIG. 3 and FIG. 4.

Also, when the engagement projection 13*a* provided on the left side surface that is one of the side surfaces of each of the plural coin boxes 11 is positioned corresponding to one of the front and back second attachment grooves 16*a* provided in the left inner side surface that is one of the side surfaces of the cash storage case 4, and the engagement projection 13*b* provided on the right inner side surface that is the other side surface of each coin box 11 is positioned corresponding to one of the front and back second attachment grooves 16*b* provided in the right inner side surface that is the other side surface of the cash storage case 4, the engagement projections 13*a* and 13*b* can be inserted into the front and back second attachment grooves 16*a* and 16*b* in the cash storage case 4, as shown in FIG. 3 and FIG. 4.

Also, when the engagement projection 13*a* provided on the left side surface that is one of the side surfaces of each of the plural coin boxes 11 is positioned corresponding to one of the front and back second attachment grooves 16*b* provided in the right inner side surface that is one of the side surfaces of the cash storage case 4, and the engagement projection 13*b* provided on the right side surface that is the other side surface of each coin box 11 is positioned corresponding to one of the front and back second attachment grooves 16*a* provided in the left inner side surface that is the other side surface of the cash storage case 4, the engagement projections 13*a* and 13*b* cannot be inserted into the front and back second attachment grooves 16*a* and 16*b* in the cash storage case 4, as shown in FIG. 3 and FIG. 4.

Accordingly, when the engagement projections 13*a* and 13*b* are positioned corresponding to and inserted into the second attachment grooves 16*a* and 16*b* of the cash storage case 4, the plurality of coin boxes 11 are arranged in the cash storage case 4 with their coin insertion openings on their open sides being oriented toward the front side of the cash storage case 4, whereby the orientation of each coin box 11 in the front-and-back direction is restricted, as shown in FIG. 3 and FIG. 4.

Figure 5:
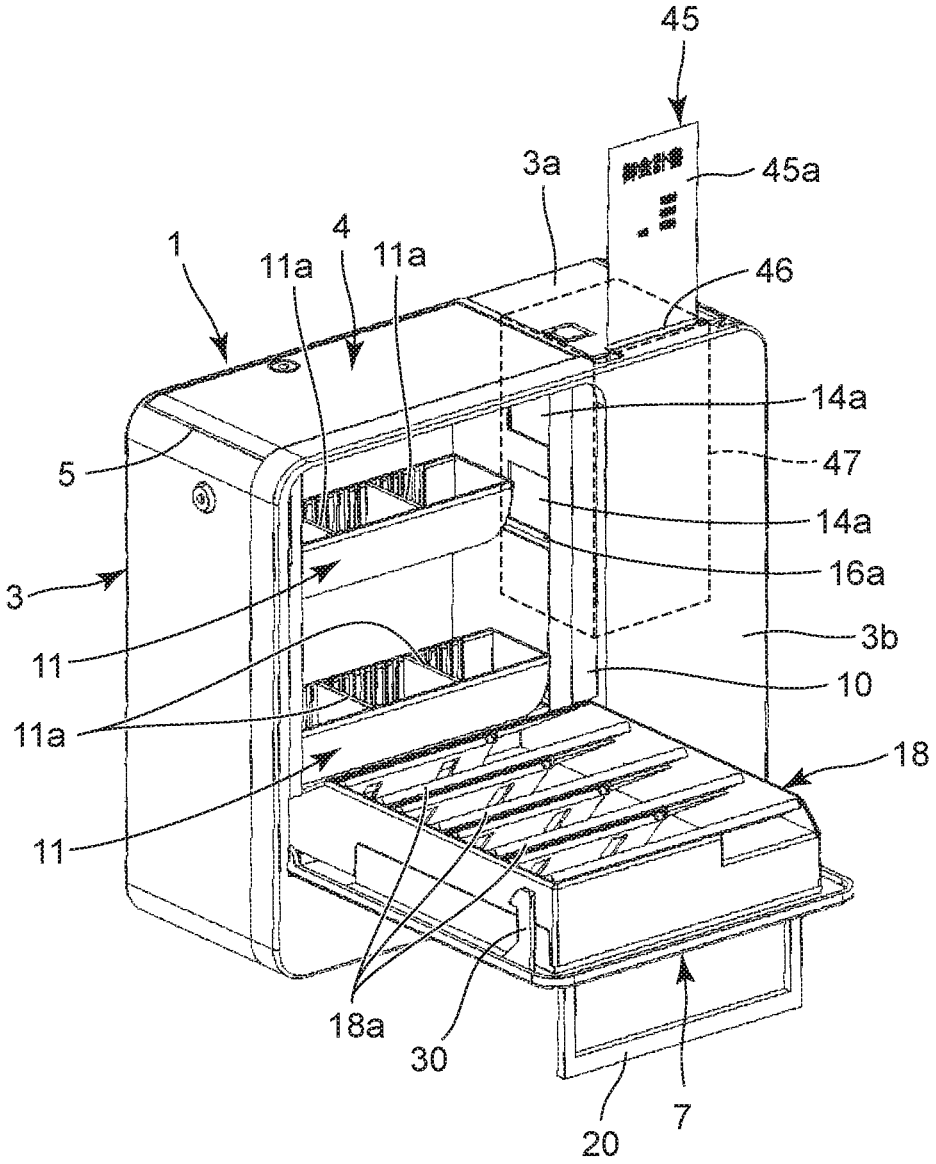
FIG. 5 is a perspective view of the cash storage apparatus shown in FIG. 1, in which the cash storage apparatus has been placed in the vertical orientation state with its open/close cover being opened.

That is, the pairs of engagement projections 13*a* and 13*b* on the plurality of coin boxes 11 and the pairs of front and back second attachment grooves 16*a* and 16*b* in the cash storage case 4 form a position restriction section which restricts the orientation of each coin box 11 in the front-and-back direction in the cash storage case 4 when the housing 3 is in the horizontal orientation state shown in FIG. 3 and FIG. 4, or in other words, the orientation of each coin box 11 in the vertical direction when the housing 3 is in the vertical orientation state shown in FIG. 5.

Accordingly, by the pairs of engagement projections 13*a* and 13*b* and the pairs of front and back second attachment grooves 16*a* and 16*b* in the cash storage case 4, the plurality of coin boxes 11 are prevented from being wrongly oriented in terms of the front-and-back direction in the cash storage case 4 when the housing 3 is in the horizontal orientation state, that is, in terms of the vertical direction in the cash storage case 4 when the housing 3 is in the vertical orientation state, as shown in FIG. 3, FIG. 4 and FIG. 5.

On the other hand, in this cash storage apparatus 1, in the vertical orientation state in which the front surface 3*a* of the housing 3 in the horizontal orientation state serves as a top surface, aback surface 3*c* opposite to the front surface 3*a* of the housing 3 in the horizontal orientation state serves as an undersurface, as shown in FIG. 1 and FIG. 5 to FIG. 8B. On the four corners of this undersurface, rubber-made leg portions 17 shown in FIG. 13B are provided. Also, in the housing 3 when the housing 3 is in the vertical orientation state, the cash storage case 4 is stored in the vertical orientation state. As a result, the case opening 5 on the upper surface of the housing 3 in the vertical orientation state is closed by the front surface of the cash storage case 4.

Also, the cash storage case 4 is structured such that, after the first bill box 12 is removed from the inside of the cash storage case 4, the plurality of coin boxes 11 are vertically arranged at two stages in the installation area where the first bill box 12 had been removed, as shown in FIG. 5 to FIG. 8B. That is, the plurality of coin boxes 11 are structured to be arranged in the cash storage case 4 with their coin insertion openings on their open sides being oriented upward, when the pairs of engagement projections 13*a* and 13*b* are slid and inserted into the pairs of second attachment grooves 16*a* and 16*b* in the cash storage case 4.

When the housing 3 is in the vertical orientation state, the open/close cover 7 provided on the housing 3 is positioned on the front side to be oriented toward the front and the rotation shaft 8*a* of the rotation mechanism 8, which is provided on the far side when the housing in the horizontal orientation state, is positioned on the lower side of the housing 3, as shown in FIG. 5 to FIG. 8B. Accordingly, the cover opening section 10 can be opened by the open/close cover 7 being rotated the rotation shaft 8*a* toward the front side. On the inner surface of the open/close cover 7, a second bill box 18 is attachably and detachably provided.

As with the first bill box 12, the second bill box 18 is to store bills by types of bills, and has a box shape whose bottom surface is substantially equal in size to the inner surface of the open/close cover 7, as shown in FIG. 5 to FIG. 8B. This second bill box 18 is formed such that it is arranged on the open/close cover 7 with the cover opening section 10 open when the housing 3 is in the vertical orientation state, and its thickness in the height direction in this state is as thin as about half the thickness of the first bill box 12 in the height direction when the housing 3 is in the horizontal orientation state.

Also, when this second bill box 18 is arranged on the open/close cover 7 with the cover opening section 10 open, its upper side is exposed as a bill insertion opening, and its inside area is partitioned by types of bills by a plurality of partition boards 18*a*, as shown in FIG. 5 to FIG. 8B. These partition boards 18*a* are provided inside the second bill box 18 with them being inclined forward, and each of them is inclined with respect to the bottom surface of the second bill box 18 at an angle larger than that of each partition board 12*a* of the first bill box 12. As a result, bills are stored in the second bill box 12 by type with them being significantly inclined toward the front side by the plurality of partition boards 12*a*.

Figure 8A:
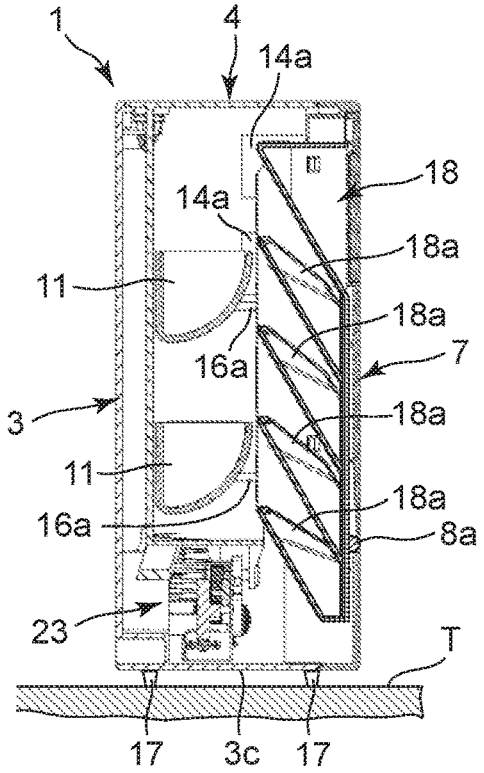

Also, when the housing 3 is in the vertical orientation state as shown in FIG. 5 to FIG. 8B, and the open/close cover 7 is rotated around the rotation shaft 8*a* positioned on the lower side so as to close the cover opening section 10 of the housing 3, the second bill box 18 is housed in the cash storage case 4 while opposing the front surface of each of the plurality of coin boxes 11 and pressing these coin boxes 11 toward the inner side, as shown in FIG. 8A.

On the outer surface of the open/close cover 7, a stand housing section 21 for housing a stand 20 is provided, as shown in FIG. 1 to FIG. 4 and FIG. 13A. The stand 20 is structured to come out of the stand housing section 21 so as to support the open/close cover 7 when the housing 3 is in the vertical orientation state and the open/close cover 7 is rotated to the front side to be in a laterally inclined state so as to open the cover opening section 10 of the housing 3.

Figure 13A:
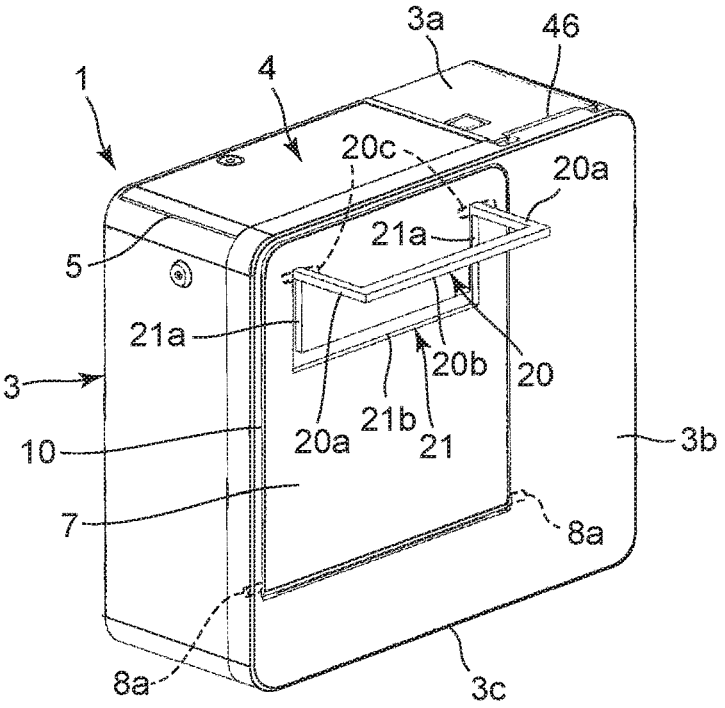
Figure 13B:
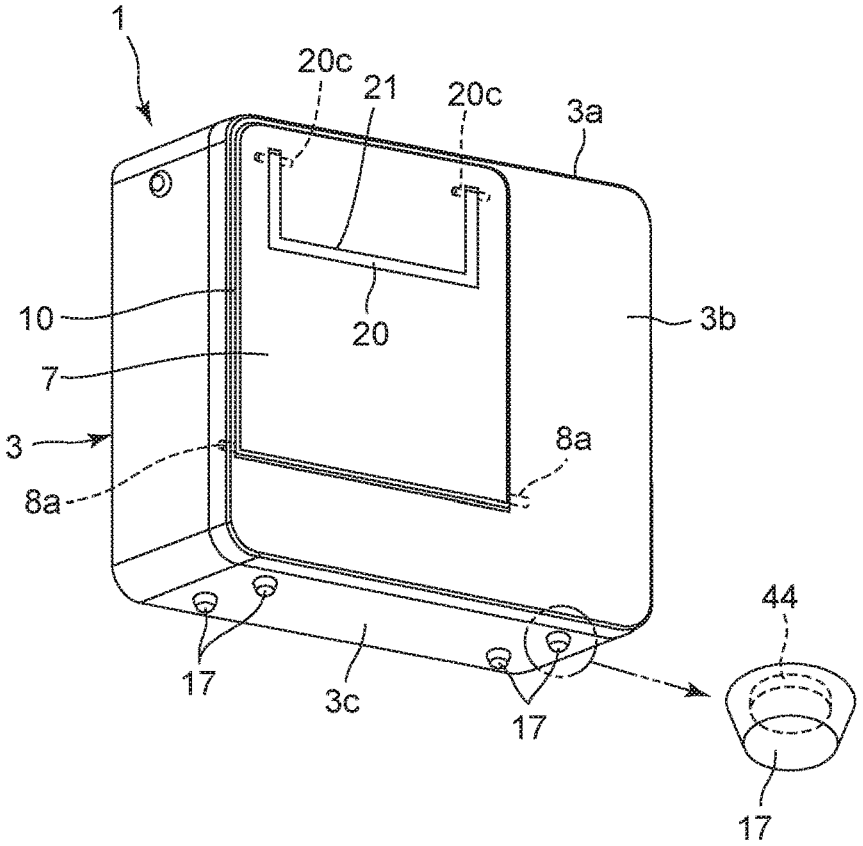

That is, this stand 20 includes a pair of arm sections 20*a* and a connection section 20*b* which connects the ends of these pair of arm sections 20*a*, as shown in FIG. 13A. The stand housing section 21 includes a pair of arm housing concave sections 21*a* where the pair of arm sections 20*a* of the stand 20 are housed with ample spacing and a connection housing concave section 21*b* where the connection section 20*b* of the stand 20 is stored with ample spacing.

By end portions of the pair of arm sections 20*a* positioned opposite to the connection section 20*b* being rotatably attached to side portions in the pair of arm housing concave sections 21*a* of the stand housing section 21 with an attachment shaft 21*c* as shown in FIG. 13A, the pair of arm sections 20*a* are housed in the pair of arm housing concave sections 21*a* of the stand housing section 21 with ample spacing, and the connection section 20*b* is housed in the connection housing concave section 21*b* of the stand housing section 21 with ample spacing. In this state, the stand 20 is rotatable with respect to the open/close cover 7.

As a result, when the housing 3 is in the vertical orientation state, the stand 20 rotates around attachment shafts 20*c* by its self-weight and is housed upright in the stand housing section 21, as shown in FIG. 1. Also, when the housing 3 is in the vertical orientation state and the open/close cover 7 is horizontally oriented so as to open the cover opening section 10 of the housing 3 as shown in FIG. 5 to FIG. 7 and FIG. 8B, the stand 20 rotates around the attachment shafts 20*c* by its self-weight and gradually comes out of the stand housing section 21 as the opening angle of the open/close cover 7 increases.

Figure 8B:
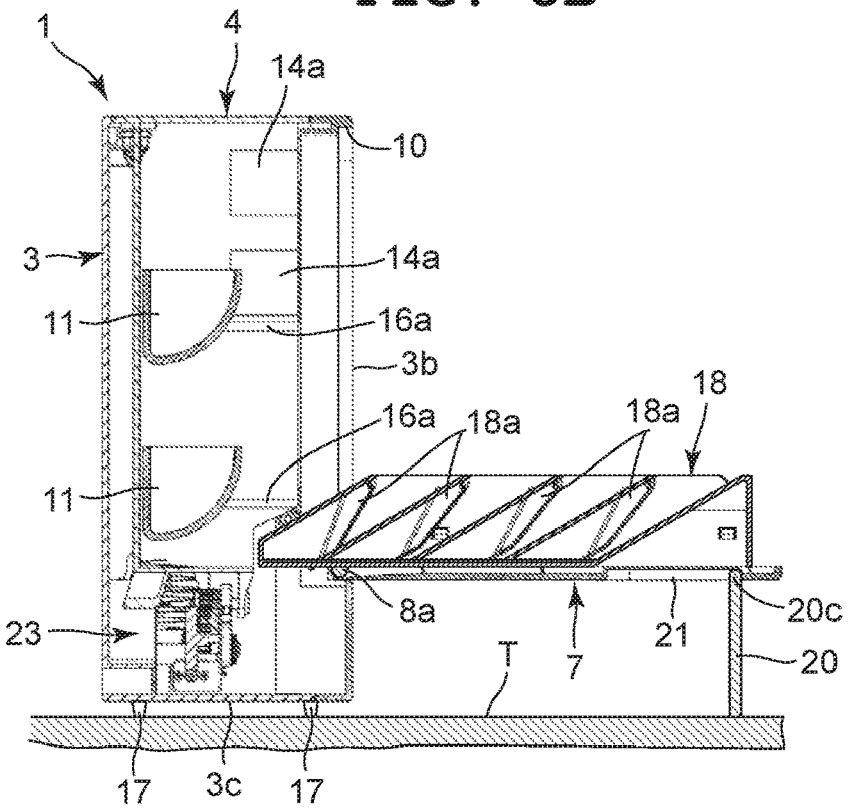

Furthermore, this stand 20 is structured such that, when the housing 3 is in the vertical orientation state, and the open/close cover 7 is rotated toward the front side to be in the laterally inclined state so as to open the cover opening section 10 of the housing 3 as shown in FIG. 5, FIG. 8B, and FIG. 13A, the pair of arm sections 20*a* becomes substantially perpendicular to the open/close cover 7, and the connection section 20*b* is arranged on a placement surface T such as a table, whereby the open/close cover 7 is supported in a substantially horizontal state.

As a result of this structure, in the present embodiment, even if the open/close cover 7 is opened to be in the laterally inclined state when the housing 3 is in the vertical orientation state, the stand 20 supports the open/close cover 7 in a horizontal state substantially parallel to the placement surface T, so that the housing 3 is placed in a stable state, as shown in FIG. 5, FIG. 8B and FIG. 13A. Without the stand 20, the barycenter position of the housing 3 moves toward the open/close cover 7 side and causes an unstable state when the open/close cover 7 is horizontally oriented with the housing 3 being in the vertical orientation state. However, with the stand 20, the housing 3 in the vertical orientation state can be stably placed with the open/close cover 7 being in the laterally inclined state.

This cash storage apparatus 1 includes a lock mechanism 22 which locks the cash storage case 4 and the open/close cover individually and an open/close mechanism 23 which individually releases the locking of the cash storage case 4 and the locking of the open/close cover 7 set by the lock mechanism 22, as shown in FIG. 9 to FIG. 12. The lock mechanism 22 includes a first lock section 24 which locks the cash storage case 4 and a second lock section 25 which locks the open/close cover 7.

Figure 9:
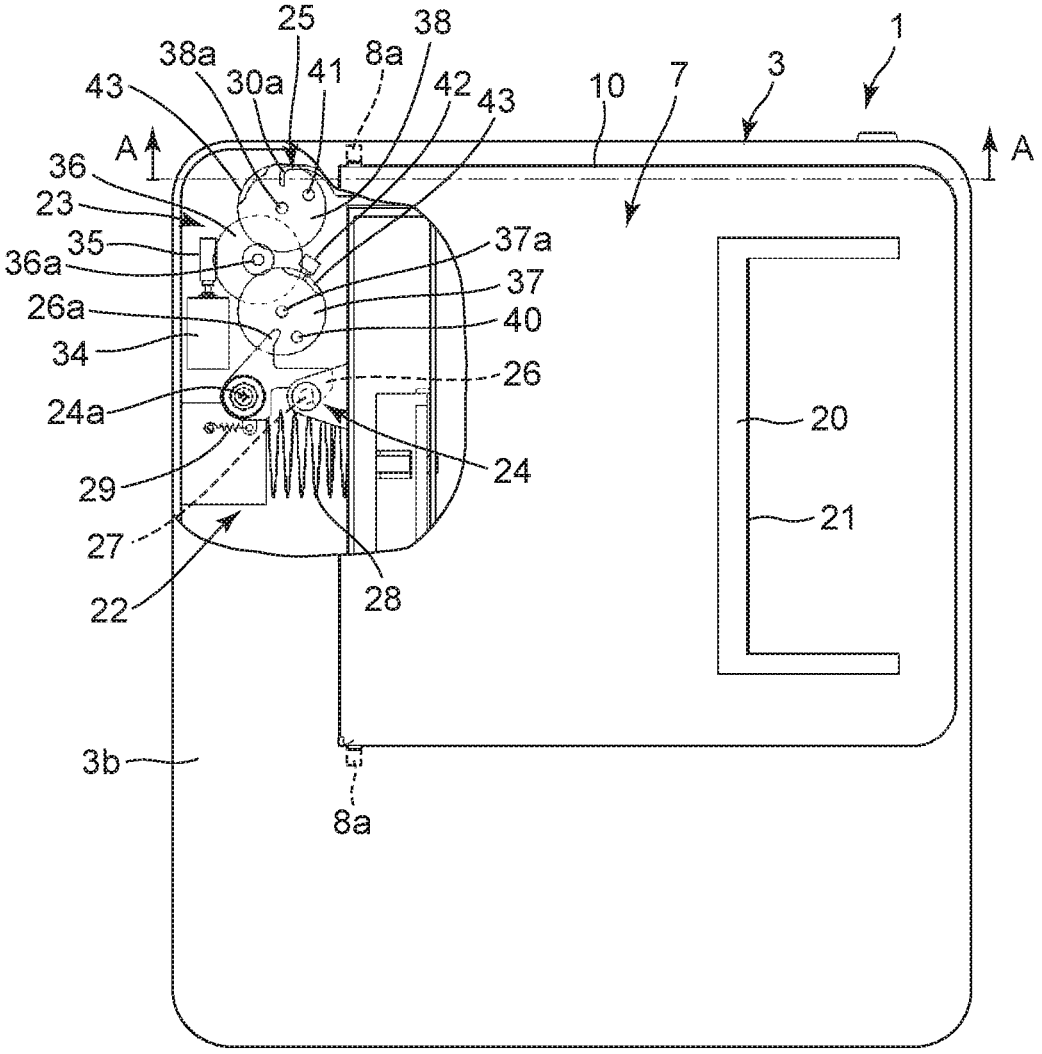
FIG. 9 is a planar view showing a lock mechanism and an open/close mechanism provided in the cash storage apparatus, in which the housing of FIG. 1 in the horizontal orientation state has been partially taken.
Figure 10:
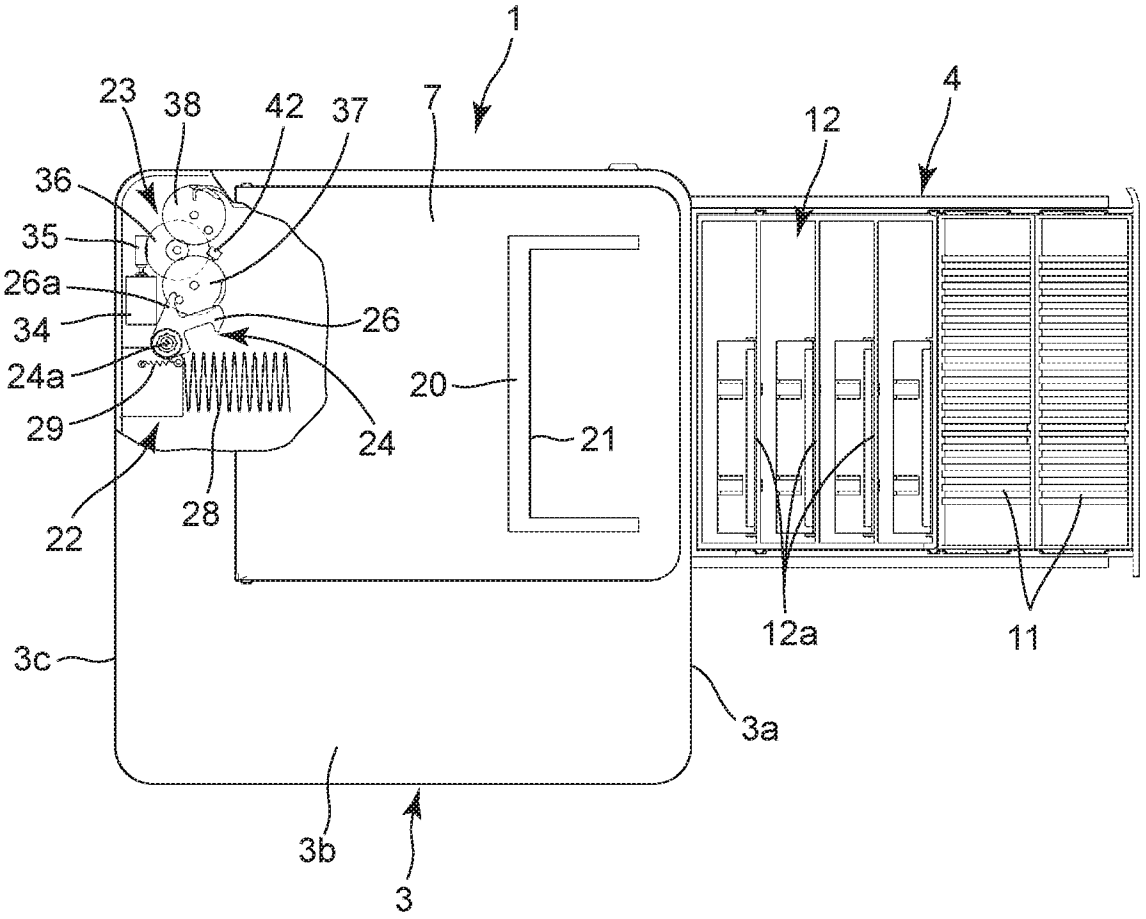
FIG. 10 is a planar view showing a state when the locking of the cash storage case by a first lock section of the lock mechanism shown in FIG. 9 is released to push out the cash storage case.

The first lock section 24 includes a rotary hook 26 rotatably provided in the housing 3 in a manner to be positioned between the far end of the cash storage case 4 and the far end of the housing 3 when the cash storage case 4 is stored in the housing 3, a case hook 27 provided on the far end of the cash storage case 4 in a manner to be removably locked to the rotary hook 26, and a first spring section 28 provided on the far inner end of the housing 3 so as to force the cash storage case 4 in a direction in which the cash storage case 4 is pushed from the case opening 5 of the housing 3 toward the outside, as shown in FIG. 9 and FIG. 10.

That is, this first lock section 24 is structured such that the rotary hook 26 is rotatably attached to a rotation support shaft 24*a* provided on the far side in the housing 3, and forced by a first auxiliary spring section 29 in a predetermined direction, or more specifically, a direction of locking the case hook 27, which is the clockwise direction, as shown in FIG. 9 and FIG. 10.

As a result, in the first lock section 24, when the cash storage case 4 is pushed into the housing 3 and the far end of the cash storage case 4 presses and compresses the first spring section 28, the case hook 27 provided on the far end of the cash storage case 4 rotates the rotary hook 26 provided on the far side in the housing 3 counterclockwise against the spring force of the first auxiliary spring section 29, and then the rotary hook 26 is rotated to the clockwise direction by the spring force of the first auxiliary spring section 29 to lock the case hook 27, whereby the cash storage case 4 pushed into the housing 3 is locked, as shown in FIG. 9 and FIG. 10.

Also, this first lock section 24 is structured such that, when the rotary hook 26 provided on the far side in the housing 3 is rotated against the spring force of the first auxiliary spring section 29 and released from the state of locking the cash storage case 4 with respect to the case hook 27, the cash storage case 4 is pushed from the inside of the housing 3 to the outside by the spring force of the first spring section 28, as shown in FIG. 9 and FIG. 10.

Figure 11A:
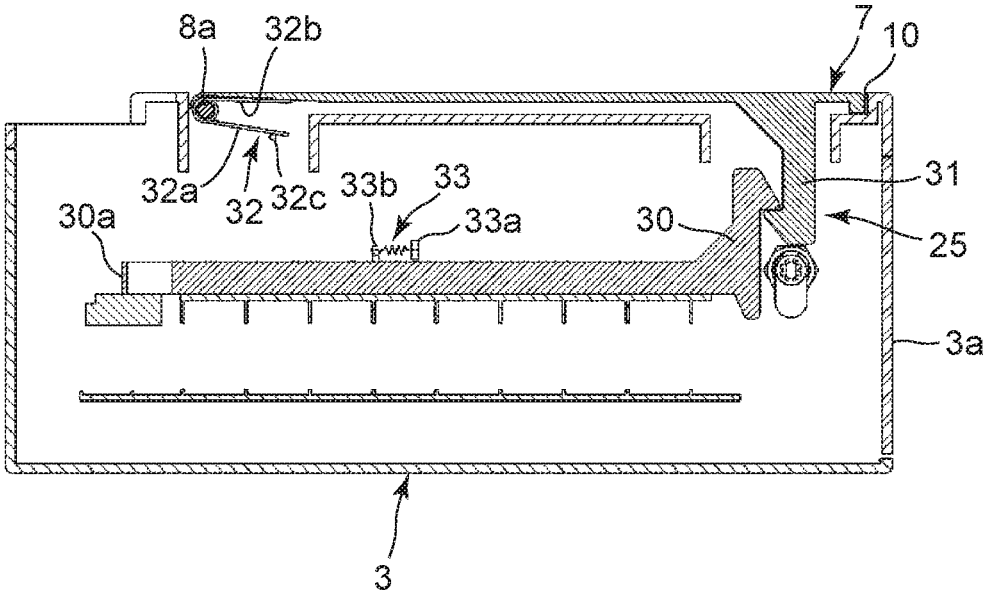
Figure 11B:
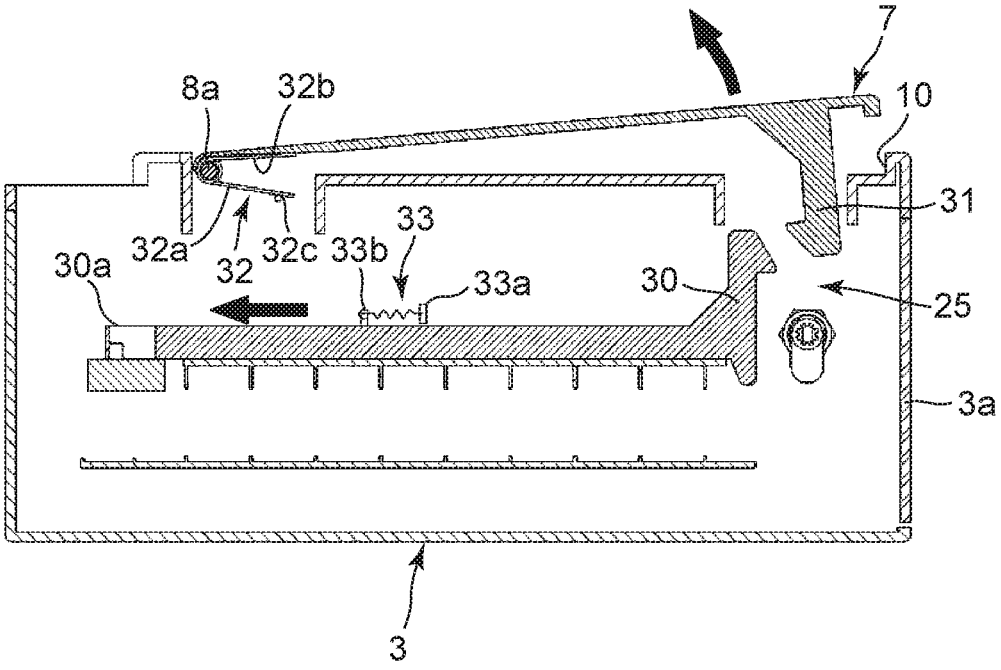

On the other hand, the second lock section 25 includes a slide hook 30 arranged in the housing 3 and positioned between a side surface of the cash storage case 4 in the width direction when the housing 3 is in the horizontal orientation state and its opposing side surface in the housing 3 in a manner to slide in the pull-out direction of the cash storage case 4, a cover hook 31 provided on the inner surface of the open/close cover 7 in a manner to be removably locked to the slide hook 30, and a second spring section 32 which presses the open/close cover 7 in a direction in which the open/close cover 7 is pushed from the cover opening section 10 to the outside, as shown in FIG. 11A and FIG. 11B.

The slide hook 30 is forced by a second auxiliary spring section 33 toward the front surface 3*a* side of the housing 3 when the housing 3 is in the horizontal orientation state, as shown in FIG. 11A and FIG. 11B. More specifically, the second auxiliary spring section 33 is structured such that its one end is attached to a fixing section 33*a* provided on the side surface of the housing 3 opposing the cash storage case 4, its other end is attached to an attachment section 33*b* provided on the slide hook 30 and, in this state, the slide hook 30 is forced toward the front surface 3*a* side of the housing 3.

The cover hook 31, which is provided on the inner surface of the open/close cover 7, is structured to be removably locked to the slide hook 30 by rotating with the open/close cover 7 around the rotation shaft 8*a* of the rotation mechanism 8, as shown in FIG. 11A and FIG. 11B. The second spring section 32 is a torsion coil spring arranged on the outer periphery of the rotation shaft 8*a*. The one end 32*a* of the second spring section 32 is locked to a fixing pin 32*c* provided on the side surface in the housing 3 and the other end 32*b* comes in resilient contact with the inner surface of the open/close cover 7 or the inner surface of the cover hook 31. In this state, the second spring section 32 presses the cover hook 31 and the open/close cover 7 in a direction in which they are pushed from the cover opening section 10, with the rotation shaft 8*a* as a fulcrum.

As a result of this structure, in the second lock section 25, when the open/close cover 7 is rotated around the rotation shaft 8*a* of the rotation mechanism 8 against the spring force of the second spring section 32 so as to close the cover opening section 10 of the housing 3, the cover hook 31 provided on the open/close cover 7 causes the slide hook 30 slidably provided in the housing 3 to slide against the spring force of the second auxiliary spring section 33, and is then locked to the slide hook 30 by the spring force of the second auxiliary spring section 33, whereby the open/close cover 7 which has closed the cover opening section 10 of the housing 3 is locked, as shown in FIG. 11A and FIG. 11B.

Also, in this second lock section 25, when the slide hook 30 slides toward the far side of the housing 3 against the spring force of the second auxiliary spring section 33, the locking state of the cover hook 31 by the slide hook 30 is released, as shown in FIG. 11B. In addition, in the second lock section 25, when the locking state of the cover hook 31 by the slide hook 30 is released, the cover hook 31 together with the open/close cover 7 rotates around the rotation shaft 8*a* of the rotation mechanism 8 by the spring force of the second spring section 32, and thereby pushes the open/close cover 7 from the cover opening section 10 of the housing 3 so as to open the cover opening section 10.

The open/close mechanism 23 includes one motor 34 serving as a driving source, a driving wheel 35 provided on an output shaft of the motor 34 so as to rotate, an intermediate wheel 36 which rotates in a forward or backward direction by the driving wheel 35, a first rotator 37 which rotates in a forward or backward direction by the intermediate wheel 36, and a second rotator 38 which rotates in a forward or backward direction by the intermediate wheel 36, as shown in FIG. 9 and FIG. 12A to FIG. 12C. This open/close mechanism 23 is provided in the housing 3 and positioned between the far end of the cash storage case 4 stored in the housing 3 and the far end of the housing 3.

The intermediate wheel 36, which is a spur gear wheel to be rotated by the driving wheel 35, is rotatably attached to an intermediate support shaft 36*a* provided in the back of the housing 3, and rotates in a forward or backward direction by the driving wheel 35 attached to the output shaft of the motor 34, as shown in FIG. 9 and FIG. 12A to FIG. 12C. The first rotator 37, which is a spur gear wheel to be engaged with the intermediate wheel 36 to rotate, is rotatably attached to a first support shaft 37*a* provided in the housing 3, and rotates in a forward or backward direction along with the rotation of the intermediate wheel 36.

Figure 12A:
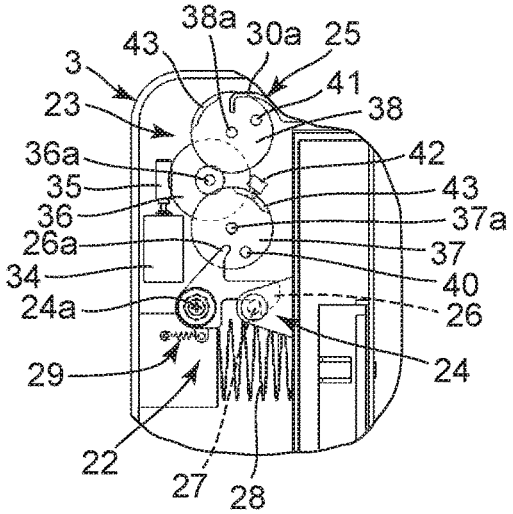
Figure 12B:
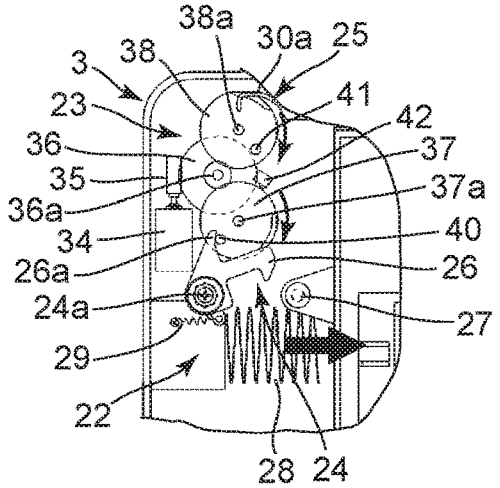

The first rotator 37 is provided with a first cam pin 40 which rotates the rotary hook 26 of the first lock section 24 when rotating in a forward direction (such as the clockwise direction), as shown in FIG. 9 and FIG. 12A to FIG. 12C. On the other hand, the rotary hook 26 is provided with a release projection 26*a* projecting on the rotary movement locus of the first cam pin 40, as shown in FIG. 12A and FIG. 12B.

As a result of this structure, when the first rotator 37 rotates in the forward direction (clockwise direction), the first cam pin 40 comes in contact with the release projection 26*a* of the rotary hook 26 to cause the release projection 26*a* to make a rotary movement, and thereby rotates the rotary hook 26 in the counterclockwise direction against the spring force of the first auxiliary spring section 29, as shown in FIG. 12B. As a result, the locking of the case hook 27 by the rotary hook 26 is released.

On the other hand, as with the first rotator 37, the second rotator 38, which is a spur gear wheel to be engaged with the intermediate wheel 36 to rotate, is rotatably attached to a second support shaft 38*a* provided in the housing 3, and rotates in a forward or backward direction along with the rotation of the intermediate wheel 36, as shown in FIG. 9 and FIG. 12A to FIG. 12C.

The second rotator 38 is provided with a second cam pin 41 which causes the slide hook 30 of the second lock section 25 to slide against the spring force of the second auxiliary spring section 33 when rotating in a backward direction (counterclockwise direction), as shown in FIG. 9 and FIG. 12A to FIG. 12C. On the other hand, the slide hook 30 is provided with a release hook 30*a* projecting on the rotary movement locus of the second cam pin 41. This second rotator 38 has the same shape and structure as those of the first rotator 37.

Figure 12C:
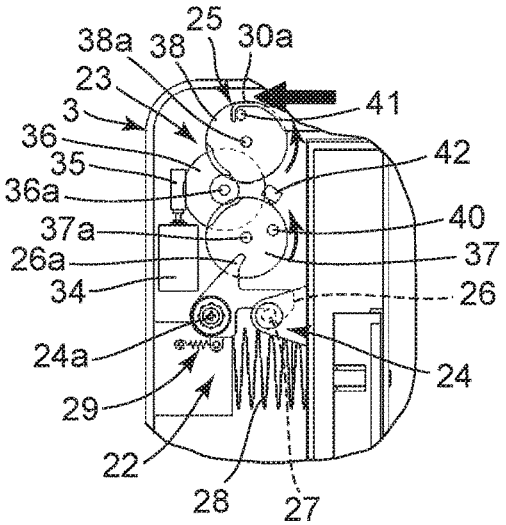

As a result of this structure, when the second rotator 38 rotates in the backward direction (counterclockwise direction), the second cam pin 41 comes in contact with the release hook 30*a* of the slide hook 30 to cause the release hook 30*a* to make a rotary movement, and thereby causes the slide hook 30 to slide against the spring force of the second auxiliary spring section 33, as shown in FIG. 12C. As a result, the locking of the cover hook 31 by the slide hook 30 is released.

That is, in this open/close mechanism 23, when the intermediate wheel 36 rotates along with the rotation of the motor 34 and whereby the first rotator 37 and the second rotator 38 rotate forward in the clockwise direction, the second cam pin 41 of the second rotator 38 makes a rotary movement in a direction away from the release hook 30*a* of the slide hook 30, and the first cam pin 40 of the first rotator 37 makes a rotary movement toward the release projection 26*a* of the rotary hook 26 to come in contact with the release projection 26*a*, whereby the rotary hook 26 is rotated against the spring force of the first auxiliary spring section 29 so as to release the locking of the case hook 27 by the rotary hook 26, as shown in FIG. 12A to FIG. 12C.

Also, in the open/close mechanism 23, when the intermediate wheel 36 rotates along with the rotation of the motor 34 and whereby the first rotator 37 and the second rotator 38 rotate backward in the counterclockwise direction, the first cam pin 40 of the first rotator 37 makes a rotary movement in a direction away from the release projection 26*a* of the rotary hook 26, and the second cam pin 41 makes a rotary movement toward the release hook 30*a* of the slide hook 30 to come in contact with the release hook 30*a*, whereby the slide hook 30 is slid against the spring force of the second auxiliary spring section 33 so as to release the locking of the cover hook 31 by the slide hook 30, as shown in FIG. 12A to FIG. 12C.

On the other hand, the open/close mechanism 23 includes a position detecting section 42 which detects a home position between the first rotator 37 and the second rotator 38, as shown in FIG. 9 and FIG. 12A to FIG. 12C. The home position herein is an intermediate position where a distance by which the first cam pin 40 of the first rotator 37 is away from the release projection 26*a* of the rotary hook 26 and a distance by which the second cam pin 41 of the second rotator 38 is away from the release hook 30*a* of the slide hook 30 are substantially equal to each other.

The position detecting section 42 is a detection element such as a microswitch or optical sensor, and detects the home position between the first rotator 37 and the second rotator 38 by detecting a notched section 43 provided in the outer periphery of the first rotator 37, as shown in FIG. 9 and FIG. 12A to FIG. 12C.

The notched section 43 of the first rotator 37 is provided at a position on the outer periphery of the first rotator 37 where a distance by which the first cam pin 40 of the first rotator 37 is away from the release projection 26*a* of the rotary hook 26 and a distance by which the second cam pin 41 of the second rotator 38 is away from the release hook 30*a* of the slide hook 30 are substantially equal to each other, as shown in FIG. 9 and FIG. 12A to FIG. 12C. Note that the second rotator 38 is also provided with the notched section 43, as with the first rotator 37.

The open/close mechanism 23 is structured such that the first rotator 37 and the second rotator 38 are rotated forward in the clockwise direction from the home position by an amount equal to a predetermined angle (for example, approximately 70 degrees) so as to release the locking of the case hook 27 by the rotary hook 26 and, after a predetermined time such as 0.5 seconds, rotated backward in the counterclockwise direction by an amount equal to a predetermined angle (for example, approximately 70 degrees), and then the rotation of the first rotator 37 and the second rotator 38 is stopped when the position detecting section 42 detects the notched section 43 of the first rotator 37, whereby both rotators are returned to the home position, as shown in FIG. 12A to FIG. 12C.

Also, this open/close mechanism 23 is structured such that the first rotator 37 and the second rotator 38 are rotated backward in the counterclockwise direction from the home position by an amount equal to a predetermined angle (for example, approximately 70 degrees) so as to release the locking of the cover hook 31 by the slide hook 30 and, after a predetermined time such as 0.5 seconds, rotated forward in the clockwise direction by an amount equal to a predetermined angle (for example, approximately 70 degrees), and then the rotation of the first rotator 37 and the second rotator 38 is stopped when the position detecting section 42 detects the notched section 43 of the first rotator 37, whereby both rotators are returned to the home position, as shown in FIG. 12A to FIG. 12C.

This cash storage apparatus 1 includes installation position detecting sections 44 which detect the horizontal orientation state and the vertical orientation state of the housing 3, as shown in FIG. 13B with dotted lines. These installation position detecting sections 44 are detection elements, such as pressure sensors, and are provided in a plurality of leg portions 17 which are on the undersurface of the housing 3 when the housing 3 is in the vertical orientation state, or on the back surface located opposite to the front surface 3*a* when the housing 3 is in the horizontal orientation state. By the weight of the housing 3 being applied when the housing 3 is in the vertical orientation state, the installation position detecting sections 44 output detection signals indicating its state. That is, the installation position detecting sections 44 are structured to detect whether the housing 3 is in the horizontal orientation state or vertical orientation state and output information regarding the detection result as detection signals.

Also, the cash storage apparatus 1 has a receipt ejection slot 46 provided in the front surface 3*a* of the housing 3 for ejecting a receipt 45 with a printing surface 45*a* oriented upward when the housing 3 is in the horizontal orientation state, as shown in FIG. 1, FIG. 2 and FIG. 5. This receipt ejection slot 46 is positioned on the side close to the upper surface 3*b* of the housing 3 having the open/close cover 7, in the front surface 3*a* of the housing 3. Also, this receipt ejection slot 46 is positioned on the left side of the cash storage case 4 when the housing 3 is in the horizontal orientation state.

Also, inside the housing 3, a printer 47 which prints information such as sales data on the printing surface 45*a* of each receipt 45 is provided corresponding to the receipt ejection slot 46, as shown in FIG. 1, FIG. 2 and FIG. 5 with two-dot-chain lines. More specifically, although not shown, this printer 47 includes a roll sheet housing section which houses a roll sheet and a printing section which prints information such as sales data by pulling out the roll sheet from this roll sheet housing section, and ejects the roll sheet printed by the printing section with the printing surface 45*a* being oriented upward, from the receipt ejection slot 46 toward the front side so as to issue the roll sheet as a receipt 45.

That is, this cash storage apparatus 1 is structured such that, when the housing 3 is in the vertical orientation state, the front surface 3*a* of the housing 3 when it is in the horizontal orientation state is positioned on the upper surface, the upper surface 3*b* of the housing 3 when it is in the horizontal orientation state is positioned on the front side and oriented frontward, and the receipt ejection slot 46 which is located in the front surface 3*a* of the housing 3 when the housing 3 is in the horizontal orientation state is positioned on the front side of the upper surface of the housing 3, as shown in FIG. 1 and FIG. 5. As a result of this structure, the printer 47 upwardly ejects a roll sheet printed by the printing section with the printing surface 45*a* being positioned on the front side and oriented toward the front, toward an area above the housing 3 from the receipt ejection slot 46 so as to issue the roll sheet as a receipt 45.

On the other hand, the tablet terminal 2 which transmits and receives data to and from the cash storage apparatus 1 has a wireless communication function, and is configured to perform processing of registering information such as sales data, and give an operation instruction to the open/close mechanism 23 of the cash storage apparatus 1 or give a printing instruction to the printer 47, as shown in FIG. 1. The cash storage apparatus 1 has a wireless communication function as well and transmits, to the tablet terminal 2, information indicating whether the housing 3 detected by the installation position detecting sections 44 is in the vertical orientation state or the horizontal orientation state.

As a result of this structure, the tablet terminal 2 transmits information such as sales data subjected to registration processing to the cash storage apparatus 1 via the wireless communication function so as to operate the printer 47 to issue a receipt 45 and operate the open/close mechanism 23 to push out the cash storage case 4 or open the open/close cover 7.

Next, the mechanism of this electronic register is described.

First, in the case where the cash storage apparatus 1 is used in the horizontal orientation state, the housing 3 is arranged on a placement surface T such as a table with the surface from which the cash storage case 4 is pulled out or pushed out as its front surface 3*a*. Here, the cash storage case 4 is pulled out in advance from the case opening 5 provided in the front surface 3*a* of the housing 3, and the plurality of coin boxes 11 and the first bill box 12 are arranged in this cash storage case 4.

In addition, the plurality of partition boards 11*a* are arranged in advance inside each coin box 11 to partition the inside of the coin box 11 by types of coins. Then, the pair of engagement projections 13*a* and 13*b* provided on the side surfaces of each coin box 11 is positioned corresponding to and inserted into the related pair of first attachment grooves 14*a* and 14*b* provided in both side surfaces in the cash storage case 4.

Here, each pair of engagement projections 13*a* and 13*b* is inserted into the corresponding pair of first attachment grooves 14*a* and 14*b* such that one engagement projection 13*a* provided on the left side surface that is one of the side surfaces of the coin box 11 corresponds to one first attachment groove 14*a* provided in the left inner side surface that is one of the side surfaces in the cash storage case 4, and the other engagement projection 13*b* provided on the right side surface that is the other side surface of the coin box 11 corresponds to the other first attachment groove 14*b* provided in the right inner side surface that is the other side surface in the cash storage case 4.

In this case, the pair of engagement projections 13*a* and 13*b* cannot be inserted into the pair of first attachment grooves 14*a* and 14*b* if the engagement projection 13*a* provided on the left side surface that is one of the side surfaces of the coin box 11 is positioned corresponding to the first attachment groove 14*b* provided in the right inner side surface that is one of the side surfaces in the cash storage case 4 and the engagement projection 13*b* provided on the right side surface that is the other side surface of the coin box 11 is positioned corresponding to the first attachment groove 14*a* provided in the left inner side surface that is the other side surface in the cash storage case 4.

When the pair of engagement projections 13*a* and 13*b* of each coin box 11 cannot be inserted into the first attachment grooves 14*a* and 14*b* in the cash storage case 4, a judgment can be made that the orientation of the coin box 11 in the front-and-back direction is opposite. Accordingly, in this case, the coin box 11 is horizontally reversed to insert each pair of left and right engagement projections 13*a* and 13*b* into the corresponding pair of first attachment grooves 14*a* and 14*b* in the cash storage case 4.

Then, when the pair of left and right engagement projections 13*a* and 13*b* of each coin box 11 is inserted into the corresponding pair of first attachment grooves 14*a* and 14*b* in the cash storage case 4, the curved surfaces of the plurality of coin boxes 11 are each oriented frontward, and the upper ends of the plurality of coin boxes 11 and the upper ends of the cash storage case 4 have the same height. These coin boxes 11 are arranged in this state on the front side in the cash storage case 4 with them being aligned.

On the other hand, when the first bill box 12 is to be arranged in the cash storage case 4, the plurality of partition boards 12*a* are arranged in advance inside the first bill box 12 to partition the inside of the first bill box 12 by types of bills. In this case, the plurality of partition boards 12*a* are each provided upright at an angle nearly perpendicular to the bottom surface of the first bill box 12, or more specifically, at an inclination angle at which the plurality of partition boards 12*a* are slightly inclined toward the front side of the first bill box 12.

Then, the first bill box 12 is arranged in the cash storage case 4 such that the pairs of front and back restriction projections 15*a* and 15*b* of the first bill box 12 are positioned correspond to and inserted into the pairs of front and back second attachment grooves 16*a* and 16*b* provided in the side surfaces in the cash storage case 4.

Here, the pairs of front and back restriction projections 15*a* and 15*b* are inserted into the pairs of front and back second attachment grooves 16*a* and 16*b* such that the front and back restriction projections 15*a* provided on the left side surface that is one of the side surfaces of the first bill box 12 correspond to the front and back second attachment grooves 16*a* provided in the left inner side surface that is one of the side surfaces in the cash storage case 4, and the front and back restriction projections 15*b* provided on the right side surface that is the other side surface of the first bill box 12 correspond to the front and back second attachment grooves 16*b* provided in the right inner side surface that is the other side surface in the cash storage case 4.

In this case, the pairs of front and back restriction projections 15*a* and 15*b* cannot be inserted into the pairs of front and back second attachment grooves 16*a* and 16*b* if the front and back restriction projections 15*a* provided on the left side surface that is one of the side surfaces of the first bill box 12 are positioned corresponding to the front and back second attachment grooves 16*b* provided in the right inner side surface that is one of the side surfaces in the cash storage case 4 and the front and back restriction projections 15*b* provided on the right side surface that is the other side surface of the first bill box 12 are positioned corresponding to the front and back second attachment grooves 16*a* provided in the left inner side surface that is the other side surface in the cash storage case 4.

Accordingly, in this case, a judgment can be made that the orientation of the first bill box 12 in the front-and-back direction is opposite. Therefore, the first bill box 12 is horizontally reversed to insert each pair of front and back restriction projections 15*a* and 15*b* into the corresponding pair of front and back second attachment grooves 16*a* and 16*b* in the cash storage case 4.

As a result, in the state where the plurality of partition boards 12*a* provided in the first bill box 12 have been slightly inclined and the undersurface of the first bill box 12 are in contact with the bottom surface of the cash storage case 4 so that the upper end of the first bill box 12 and the upper end of the cash storage case 4 are equal in height, the first bill box 12 is arranged on the far side in the cash storage case 4 without its front side and back side being wrongly oriented.

In the above-described state, the cash storage case 4 is pushed into and housed in the housing 3. Here, the cash storage case 4 is locked in the housing 3 by the first lock section 24 of the lock mechanism 22. That is, when the cash storage case 4 is pushed into the housing 3, the end of the cash storage case 4 on the far side presses and compresses the first spring section 28 of the first lock section 24.

Here, the case hook 27 provided on the end of the cash storage case 4 on the far side rotates the rotary hook 26 provided on the far side of the housing 3 against the spring force of the first auxiliary spring section 29, and then the rotary hook 26 rotates in the reverse direction by the spring force of the first auxiliary sprint section 29 so as to lock the case hook 27. As a result, the cash storage case 4 is locked in the housing 3.

Also, when the housing 3 is in the horizontal orientation state, the open/close cover 7 positioned on the upper surface 3*b* of the housing 3 is pressed toward the upper surface 3*b* to close the cover opening section 10 of the housing 3. Here, the open/close cover 7 is locked to the housing 3 by the second lock section 25 of the lock mechanism 22 with the stand 20 being housed in the stand housing section 21 in the open/close cover 7 by rotating by its self-weight.

That is, when the open/close cover 7 is rotated around the rotation shaft 8*a* of the rotation mechanism 8 against the spring force of the second spring section 32 of the second lock section 25 so as to close the cover opening section 10 of the housing 3, the cover hook 31 of the second lock section 25 provided on the open/close cover 7 causes the slide hook 30 slidably provided in the housing 3 to slide against the spring force of the second auxiliary spring section 33, and then the slide hook 30 slides by the spring force of the second auxiliary spring section 33 so as to lock the cover hook 31. As a result, the open/close cover 7 is locked while closing the cover opening section 10 of the housing 3.

In this state, when the cash storage apparatus 1 is to be used in the horizontal orientation state, the tablet terminal 2 is first operated to give an instruction of operating the open/close mechanism 23 to the cash storage apparatus 1 via wireless communication. Here, the weight of the cash storage apparatus 1 has not been applied to the plurality of leg portions 17 provided on the back surface 3*c* of the housing 3 in the horizontal orientation state. Accordingly, the installation position detecting sections 44 of the cash storage apparatus 1 detect that the housing 3 is in the horizontal orientation state. Then, based on detection signals from the installation position detecting sections 44, the tablet terminal 2 gives an operation instruction to the open/close mechanism 23 of the cash storage apparatus 1.

Next, the motor 34 of the open/close mechanism 23 rotates to cause the driving wheel 35 to rotate the intermediate wheel 36. This intermediate wheel 36 causes the first rotator 37 and the second rotator 38 to rotate forward in the clockwise direction. That is, here, the first rotator 37 and the second rotator 38 have been arranged at the home position where the position detecting section 42 has detected the notched section 43 provided on the outer periphery of the first rotator 37.

In this state, when the first rotator 37 and the second rotator 38 rotate forward in the clockwise direction by an amount equal to a predetermined angle (for example, approximately 70 degrees), the second cam pin 41 of the second rotator 38 makes a rotary movement in a direction away from the release hook 30*a* of the slide hook 30, and the first cam pin 40 of the first rotator 37 makes a rotary movement toward the release projection 26*a* of the rotary hook 26 so as to come in contact with the release projection 26*a*, whereby the rotary hook 26 is rotated against the spring force of the first auxiliary spring section 29.

As a result, the locking of the case hook 27 by the rotary hook 26 is released, and the first spring section 28 pushes out the cash storage case 4 by the spring force, from the case opening 5 of the housing 3 toward the outside. Furthermore, after a predetermined time such as 0.5 seconds, the motor 34 rotates backward to cause the first rotator 37 and the second rotator 38 to rotate backward in the counterclockwise direction. Then, when the position detecting section 42 detects the notched section 43 of the first rotator 37, the rotation of the motor 34 is stopped, and the first rotator 37 and the second rotator 38 are returned to the home position.

In this state, when cash is exchanged between the operator and a customer and information such as sales data is inputted via the tablet terminal 2, the tablet terminal 2 transmits this inputted information to the cash storage apparatus 1 via wireless communication and gives an operation instruction to the printer 47. Then, the printer 47 pulls out the roll sheet from the roll sheet housing section to print the information such as sales data at the printing section, and ejects the printed roll sheet with the printing surface 45*a* oriented upward from the receipt ejection slot 46 toward the front side of the housing 3 so as to issue the roll sheet as a receipt 45.

Next, the case is described in which the cash storage apparatus 1 is used in the vertical orientation state.

In this case, the front surface 3*a* of the housing 3, which is located on the side from which the cash storage case 4 is pulled out or pushed out, is set as an upper surface, the upper surface 3*b* of the housing 3 when it is in the horizontal orientation state is positioned on the front side and oriented frontward, the back surface 3*c* located on the far side of the housing 3 when it is in the horizontal orientation state is set as a lower surface, and the cash storage apparatus 1 is arranged on a placement surface T such as a table. Here, the housing 3 is arranged in the vertical orientation state with the plurality of leg portions 17 at the four corners of the back surface 3*c* of the housing 3 being pressed onto the placement surface T such as a table.

In this embodiment, before this arrangement, the housing 3 is first set in the horizontal orientation state, the cash storage case 4 is pulled out from the case opening 5 of the housing 3, and the first bill box 12 is taken out of this cash storage case 4. Then, in this state, the plurality of coin boxes 11 are arranged in the cash storage case 4 with them being horizontally oriented. That is, the coin insertion opening of each coin box 11 on the open side is laterally oriented, and the pairs of engagement projections 13*a* and 13*b* of the coin boxes 11 are inserted from above into the pairs of front and back second attachment grooves 16*a* and 16*b* in the cash storage case 4, as shown in FIG. 4.

Here, the pairs of engagement projections 13*a* and 13*b* are inserted into the pairs of second attachment grooves 16*a* and 16*b* such that each engagement projection 13*a* provided on the left side surface that is one of the side surfaces of each coin box 11 is positioned corresponding to each second attachment groove 16*a* provided in the left inner side surface that is one of the side surfaces in the cash storage case 4 and each engagement projection 13*b* provided on the right side surface that is the other side surface of each coin box 11 is positioned corresponding to each second attachment groove 16*b* provided in the right inner side surface that is the other side surface in the cash storage case 4.

Here, the pairs of engagement projections 13*a* and 13*b* cannot be inserted into the pairs of second attachment grooves 16*a* and 16*b* if each engagement projection 13*a* provided on the left side surface that is one of the side surfaces of each coin box 11 is positioned corresponding to each second attachment groove 16*b* provided in the right inner side surface that is one of the side surfaces in the cash storage case 4 and each engagement projection 13*b* provided on the right side surface that is the other side surface of each coin box 11 is positioned corresponding to each second attachment groove 16*a* provided in the left inner side surface that is the other side surface in the cash storage case 4.

In this case, a judgment can be made that the orientation of each coin box 11 in the front-and-back direction is opposite. Accordingly, each of the plurality of coin boxes 11 is horizontally reversed so as to insert each pair of front and back restriction projections 15*a* and 15*b* into the corresponding pair of front and back second attachment grooves 16*a* and 16*b* in the cash storage case 4.

As a result, when the pairs of engagement projections 13*a* and 13*b* of the plurality of coin boxes 11 are respectively inserted into the pairs of second attachment grooves 16*a* and 16*b* of the cash storage case 4, the orientation of each coin box 11 in the cash storage case 4 in the front-and-back direction when the housing 3 is in the horizontal orientation state, that is, the orientation in the vertical direction when the housing 3 is in the vertical orientation state is not mistaken, and each coin box 11 is arranged with its coin insertion opening on its open side being laterally oriented in the cash storage case 4.

Accordingly, when the cash storage case 4 is pushed into the housing 3 and the housing 3 is arranged in the vertical orientation state on the placement surface T such as a table, the cash storage case 4 is arranged in the housing 3 in the vertical orientation state, and the plurality of coin boxes 11 are arranged vertically at two stages in the cash storage case 4 in the vertical orientation state with the coin insertion opening on the open side being oriented upward.

Also, here, by the cash storage case 4 being pushed into the housing 3, the end of the cash storage case 4 on the far side presses and compresses the first spring section 28 of the first lock section 24, the case hook 27 provided on the end of the cash storage case 4 on the far side rotates the rotary hook 26 on the far side in the housing 3 in the counterclockwise direction against the spring force of the first auxiliary spring section 29, and then the rotary hook 26 rotates in the reverse direction by the spring force of the first auxiliary spring section 29 so as to lock the case hook 27. As a result, the cash storage case 4 is locked in the housing 3.

When the housing 3 is to be used in the vertical orientation state, first, the open/close cover 7 is opened in this vertical orientation state, and the second bill box 18 is arranged on the upper surface, that is, the inner surface of the open/close cover 7. The upper surface side of this second bill box 18 is open as a bill insertion opening, and the inside is partitioned by types of bills by the plurality of partition boards 18*a*. In the vertical orientation state, the plurality of partition boards 18*a* are inclined with respect to the bottom surface of the second bill box 18 such that they are inclined toward the front side of the second bill box 18 at an angle larger than that of the partition boards 12*a* of the first bill box 12.

As a result of this structure, when the housing 3 is in the vertical orientation state and the open/close cover 7 is rotated around the rotation shaft 8*a* of the rotation mechanism 8 positioned on the lower side so as to close the cover opening section 10 of the housing 3, the second bill box 18 is housed in the cash storage case 4 with its bill insertion opening on its open side opposing the front side of the plurality of coin boxes 11 and pressing the plurality of coin boxes 11 toward the far side, as shown in FIG. 8A.

Also, when the open/close cover 7 closes the cover opening section 10 of the housing 3, the cover hook 31 of the second lock section 25 provided on the open/close cover 7 causes the slide hook 30 slidably provided in the housing 3 to slide against the spring force of the second auxiliary spring section 33, and then the cover hook 31 is locked to the slide hook 30 by the spring force of the second auxiliary spring section 33. As a result, the open/close cover 7 is locked while closing the cover opening section 10 of the housing 3.

When the cash storage apparatus 1 is to be used in the vertical orientation state, first, the tablet terminal 2 is operated to give an instruction for operating the open/close mechanism 23 to the cash storage apparatus 1 via wireless communication. Here, the weight of the cash storage apparatus 1 is applied to the plurality of leg portions 17, which are on the back surface 3*c* of the housing 3 when the housing 3 is the horizontal orientation state, and causes the installation position detecting sections 44 of the cash storage apparatus 1 to detect the vertical orientation state of the housing 3. Then, base on detection signals from the installation position detecting sections 44, the tablet terminal 2 gives an operation instruction to the open/close mechanism 23 of the cash storage apparatus 1.

Here, the motor 34 of the open/close mechanism 23 rotates backward and causes the driving wheel 35 to rotate the intermediate wheel 36. This intermediate wheel 36 causes the first rotator 37 and the second rotator 38 to rotate backward in the counterclockwise direction. That is, here, the first rotator 37 and the second rotator 38 have been arranged at the home position where the position detecting section 42 has detected the notched section 43 provided on the outer periphery of the first rotator 37.

In this state, when the first rotator 37 and the second rotator 38 are rotated backward in the counterclockwise direction by an amount equal to a predetermined angle (for example, 70 degrees), the first cam pin 40 of the first rotator 37 makes a rotary movement in a direction away from the release projection 26*a* of the rotary hook 26, and the second cam pin 41 makes a rotary movement toward the release hook 30*a* of the slide hook 30 so as to come in contact with the release hook 30*a*, whereby the slide hook 30 is slid against the spring force of the second auxiliary spring section 33.

As a result, the locking of the cover hook 31 by the slide hook 30 of the second lock section 25 is released. Then, the cover hook 31 together with the open/close cover 7 rotates around the rotation shaft 8*a* of the rotation mechanism 8 by the spring force of the second spring section 32 so as to push the open/close cover 7 from the cover opening section 10 of the housing 3 and open the cover opening section 10. Furthermore, after a predetermined time such as 0.5 seconds, the motor 34 rotates forward to cause the first rotator 37 and the second rotator 38 to rotate forward in the clockwise direction. Then, when the position detecting section 42 detects the notched section 43 of the first rotator 37, the rotation of the motor 34 is stopped, and the first rotator 37 and the second rotator 38 are returned to the home position.

When the open/close cover 7 is rotated to be opened as described above, the stand 20 in an upright state rotates by its self-weight around the attachment shafts 20*c* to gradually come out of the stand housing section 21 in accordance with the opening angle, that is, the horizontal orientation angle of the open/close cover 7. Then, when the housing 3 is in the vertical orientation state and the open/close cover 7 is rotated toward the front side to be in the laterally inclined state so as to open the cover opening section 10 of the housing 3, the pair of arm sections 20*a* of the stand 20 becomes substantially perpendicular to the open/close cover 7, the connection section 20*b* of the stand 20 is arranged on the placement surface T such as a table, and the stand 20 supports the open/close cover 7 in a horizontal state substantially parallel to the placement surface T.

As a result of this structure, even when the open/close cover 7 is opened to be in the laterally inclined state with the housing 3 being in the vertical orientation state, the housing 3 can be arranged in a stable state by the stand 20. That is, when the housing 3 is in the vertical orientation state and the open/close cover 7 is in the laterally inclined state, the barycenter position of the housing 3 is moved toward the open/close cover 7 side, which makes the housing 3 unstable. However, by the stand 20, the housing 3 in the vertical orientation state when the open/close cover 7 is in the laterally inclined state can be arranged in a stable state. In this state, the plurality of coin boxes 11 is slid frontward to be positioned on the front side and be closer to the cover opening section 10, whereby coins can be easily put in the coin boxes 11.

Then, when cash is exchanged between the operator and a customer and information such as sales data is inputted via the tablet terminal 2, the tablet terminal 2 transmits this inputted information to the cash storage apparatus 1 via wireless communication and gives an operation instruction to the printer 47. Then, the printer 47 pulls out the roll sheet from the roll sheet housing section so as to print the information such as sales data at the printing section, and ejects the printed roll sheet with the printing surface 45*a* being oriented frontward, from the receipt ejection slot 46 toward an area above the housing 3, whereby the roll sheet is issued as a receipt 45.

As described above, according to this cash storage apparatus 1 of the electronic register, the housing 3 is structured such that its length in the depth direction is longer than its length in the height direction when it is in the horizontal orientation state where its surface from which the cash storage case 4 is pulled out or pushed out serves as the front surface 3*a*. In addition, in order to enable the housing 3 to be used in the vertical orientation state where the front surface 3*a* when the housing 3 is in the horizontal orientation state serves as an upper surface, a portion of the upper surface 3*b* of the housing 3 when it is in the horizontal orientation state serves as the open/close cover 7 that is opened frontward. As a result, the housing 3 can be favorably installed regardless of whether the installation space is wide or narrow.

That is, when the cash storage apparatus 1 of the electronic register is in the horizontal orientation state, the cash storage case 4 can be pulled out or pushed out from the front surface 3*a* of the housing 3, which allows the cash storage apparatus 1 to be arranged in a wide installation space and favorably used in a stable state. Also, in the vertical orientation state where the front surface 3*a* of the housing 3 when it is in the horizontal orientation state serves as an upper surface, the upper surface 3*b* of the housing 3 when it is in the horizontal orientation state can be positioned on the front side and oriented frontward. Therefore, the open/close cover 7 which is a portion of the upper surface 3*b* can be positioned on the front side and opened toward the front. Accordingly, the cash storage apparatus can be favorably used even when it is arranged in a narrow installation space with the housing 3 being in the vertical orientation state.

Also, on the open/close cover 7 of the cash storage apparatus 1, the rotation shaft 8*a* of the rotation mechanism 8 is positioned on the far side in the depth direction of the housing 3 in the horizontal orientation state. Therefore, in the vertical orientation state where the front surface 3*a* of the housing 3 when it is in the horizontal orientation state serves as an upper surface, the upper surface 3*b* of the housing 3 when it is in the horizontal orientation state can be positioned on the front side and oriented toward the front, and the rotation shaft 8*a* can be positioned on a lower portion on the front side. Accordingly, the open/close cover 7 can be rotated around the rotation shaft 8*a* toward the front side and favorably opened. Therefore, the cash storage apparatus 1 can be favorably used even in the vertical orientation state.

Furthermore, the housing 3 is structured such that its length in the depth direction is longer than its length in the height direction when the cash storage apparatus 1 of the electronic register is arranged in the horizontal orientation state where its surface from which the cash storage case 4 is pulled out or pushed out serves as the front surface 3*a*, and a receipt 45 is ejected from the receipt ejection slot 46 with its printing surface 45*a* being oriented upward. In addition, in order to allow the use in the vertical orientation state where the printing surface 45*a* of a receipt 45 to be ejected from the receipt ejection slot 46 is oriented frontward, a portion of the upper surface of the housing 3 when it is in the horizontal orientation state is constituted by the open/close cover 7 that is opened frontward. As a result, the cash storage apparatus 1 can be favorably installed regardless of whether the installation space of the housing 3 is wide or narrow.

That is, in this cash storage apparatus 1 of the electronic register, in the horizontal orientation state, the cash storage case 4 can be pulled out or pushed out from the front surface 3*a* of the housing 3, and a receipt 45 can be ejected from the receipt ejection slot 46 on the front surface 3*a* side of the housing 3 with the printing surface 45*a* being oriented upward. As a result, the printing surface 45*a* of the receipt 45 ejected from the receipt ejection slot 46 can be checked by the operator. Also, the cash storage apparatus 1 can be arranged in a wide installation space and favorably used in a more stable state.

Also, in this cash storage apparatus 1, a portion of the upper surface 3*b* of the housing 3 when it is in the horizontal orientation state serves as the open/close cover 7 and, in the vertical orientation state where the front surface 3*a* of the housing 3 serves as an upper surface, the upper surface 3*b* can be positioned on the front side and oriented frontward. Accordingly, in the vertical orientation state, the open/close cover 7 can be opened frontward, and a receipt 45 whose printing surface 45*a* has been oriented frontward can be upwardly ejected from the receipt ejection slot 46 toward an area above the upper surface of the housing 3. Therefore, even when the housing 3 in the vertical orientation state is arranged in a narrow installation space, the printing surface 45*a* of a receipt 45 ejected from the receipt ejection slot 46 can be checked by the operator, whereby the cash storage apparatus 1 can be favorably used.

In this case as well, on the open/close cover 7 of the cash storage apparatus 1, since the rotation shaft 8*a* of the rotation mechanism 8 is positioned on the far side in the depth direction when the housing 3 is in the horizontal orientation state, the upper surface 3*b* of the housing 3 when it is in the horizontal orientation state can be positioned on the front side and oriented frontward and the printing surface 45*a* of a receipt 45 to be ejected from the receipt ejection slot 46 can be oriented frontward even in the vertical orientation state. Accordingly, the rotation shaft 8*a* can be positioned on the lower portion of the housing 3 on the front side, which allows the open/close cover 7 to rotate around the rotation shaft 8*a* toward the front side and favorably opened. As a result, the cash storage apparatus 1 can be favorably used even in the vertical orientation state.

Also, in this cash storage apparatus 1, the receipt ejection slot 46 is in the front surface 3*a* of the housing 3 when it is in the horizontal orientation state. Therefore, in the horizontal orientation state, a receipt 45 can be favorably ejected with the printing surface 45*a* being upwardly oriented, from the receipt ejection slot 46 toward the front surface 3*a* side of the housing 3. Also, in the vertical orientation state, a receipt 45 can be favorably and upwardly ejected from the receipt ejection slot 46 toward an area above the housing 3, with the printing surface 45*a* being oriented to the front surface side of the housing 3.

Moreover, in this cash storage apparatus 1, in the housing 3, the printer 47 for printing information on the printing surface 45*a* of a receipt 45 is provided corresponding to the receipt ejection slot 46. Therefore, in both cases where the housing 3 is in the horizontal orientation state or the vertical orientation state, the printing surface 45*a* of a receipt 45 printed by the printer 47 can be viewed by the operator. That is, the receipt 45 can be favorably issued from the receipt ejection slot 46.

More specifically, the printer 47 includes the roll sheet housing section which stores a roll sheet and the printing section which prints information such as sales data by pulling out the roll sheet from the roll sheet housing section. Therefore, when the housing 3 is in the horizontal orientation state, the roll sheet printed by the printing section can be reliably and favorably issued as a receipt 45 from the receipt ejection slot 46 to the front surface 3*a* side of the housing 3, with the printing surface 45*a* being oriented upward. Also, when the housing 3 is in the vertical orientation state, the printer 47 can reliably and favorably eject the roll sheet printed by the printing section from the receipt ejection slot 46 toward an area above the housing 3 with the printing surface 45*a* being oriented toward the front surface side of the housing 3, and thereby can issue the roll sheet as a receipt 45.

Furthermore, in this cash storage apparatus 1 of the electronic register, the housing 3 is structured such that its length in the depth direction is longer than its length in the height direction when it is in the horizontal orientation state where its surface from which the cash storage case 4 is pulled out or pushed out serves as the front surface 3*a*. In addition, in order to enable the housing 3 to be used in the vertical orientation state where the front surface 3*a* when the housing 3 is in the horizontal orientation state serves as an upper surface, the leg portions 17 for placing the housing 3 in the vertical orientation state are provided on the back surface 3*c* of the housing 3 when it is in the horizontal orientation state. As a result, the cash storage apparatus 1 can be favorably installed regardless of whether the installation space of the housing 3 is wide or narrow.

That is, in this cash storage apparatus 1 of the electronic register, in the horizontal orientation state, the cash storage case 4 can be pulled out or pushed out from the front surface 3*a* of the housing 3, which allows the cash storage apparatus 1 to be arranged in a wide installation space and favorably used in a stable state. Also, in the vertical orientation state where the front surface 3*a* of the housing 3 when it is in the horizontal orientation state serves as an upper surface, the back surface 3*c* of the housing 3 when it is in the horizontal orientation state can be oriented to the lower surface. Therefore, the leg portions 17 provided on the back surface 3*c* of the housing 3 can be reliably and favorably arranged on the placement surface T such as a table. As a result, the housing 3 in the vertical orientation state can be favorably arranged in a narrow installation space so as to use the cash storage apparatus 1.

Also, in this cash storage apparatus 1, in order to enable the housing 3 to be used in the vertical orientation state where the front surface 3*a* when the housing 3 is in the horizontal orientation state serves as an upper surface, a portion of the upper surface 3*b* of the housing 3 when it is in the horizontal orientation state serves as the open/close cover 7 that is opened frontward. Therefore, in the vertical orientation state where the front surface 3*a* of the housing 3 when it is in the horizontal orientation state serves as an upper surface, the upper surface 3*b* of the housing 3 when it is in the horizontal orientation state can be oriented frontward. Accordingly, the open/close cover 7 which is a portion of the upper surface 3*b* can be opened toward the front side of the housing 3. As a result, the cash storage apparatus 1 can be favorably used even when the housing 3 in the vertical orientation state is arranged in a narrow installation space.

In the above-described embodiment, the stand 20 is structured to include the pair of arm sections 20*a* and the connection section 20*b* which connects ends of the pair of arm sections 20*a*. However, the present invention is not limited thereto. For example, a structure such as that in a first modification example shown in FIG. 14A or a structure such as that in a second modification example shown in FIG. 14B may be adopted.

Figure 14A:
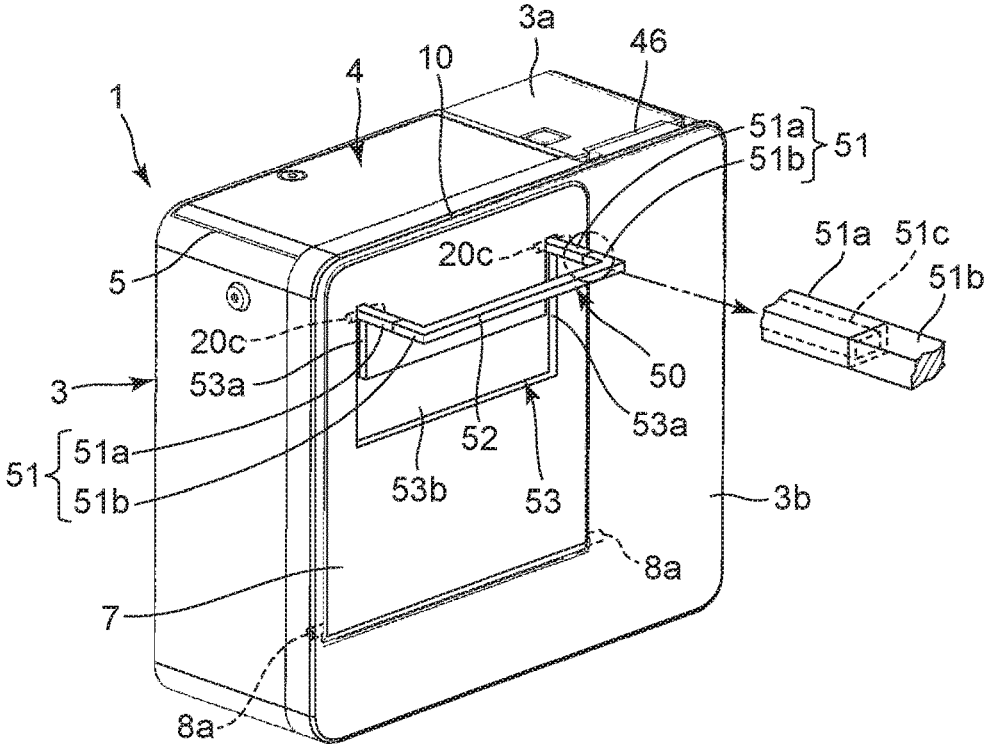

More specifically, a stand 50 of the first modification example shown in FIG. 14A is structured such that its length in a direction in which it hangs down by its self-weight is adjustable. That is, in this stand 50, each arm section 51 includes a fixed arm 51*a* having a rectangular cylindrical shape and a slide arm 51*b* having an inserting section 51*c* that is slidably inserted into the fixed arm 51*a* with it being in pressure contact with the fixed arm 51*a*.

The fixed arm 51*a* having the inserting section 51*c* inserted therein is rotatably attached to the open/close cover 7 by the attachment shaft 20*c* in a stand storage section 53. The ends of the slide arms 51*b* positioned opposite to their inserting sections 51*c* are connected by a connection section 52. Also, the stand storage section 53 is structured to include a pair of arm housing sections 53*a* for housing the pair of arm sections 51 and a connection housing section 53*b* for housing the connection section 52, and this connection housing section 53*b* is widely formed having a stand width equal in length to the slide length of the slide arm 51*b*.

Thus, according to the stand 50 of the first modification example, when the cover opening section 10 of the housing 3 in the vertical orientation state is exposed by the open/close cover 7 being rotated to the front side so as to be in the laterally inclined state, the pair of arm sections 51 comes out of the stand storage section 53 by their self-weight so that the connection section 52 can be arranged on a placement surface T such as a table.

Here, when the open/close cover 7 has been inclined in the vertical direction with respect to the placement surface T such as a table, the length of the inserting section 51*c* of each slide arm 51*b* to be inserted into the corresponding fixed arm 51*a* is adjusted so as to adjust the length of the pair of arm sections 51, whereby the pair of arm sections 51 can be substantially perpendicular to the open/close cover 7. As a result, the open/close cover 7 can be favorably and horizontally supported by the stand 50 with it being substantially parallel to the placement surface T such as a table.

Also, with this stand 50, by the length of the inserting section 51*c* of each slide arm 51*b* to be inserted into the corresponding fixed arm 51*a* being adjusted so as to adjust the length of the pair of arm sections 51 such that the cash storage apparatus 1 is used with the open/close cover 7 being inclined upward with respect to the placement surface T such as a table, the installation space can be further narrowed.

Figure 14B:
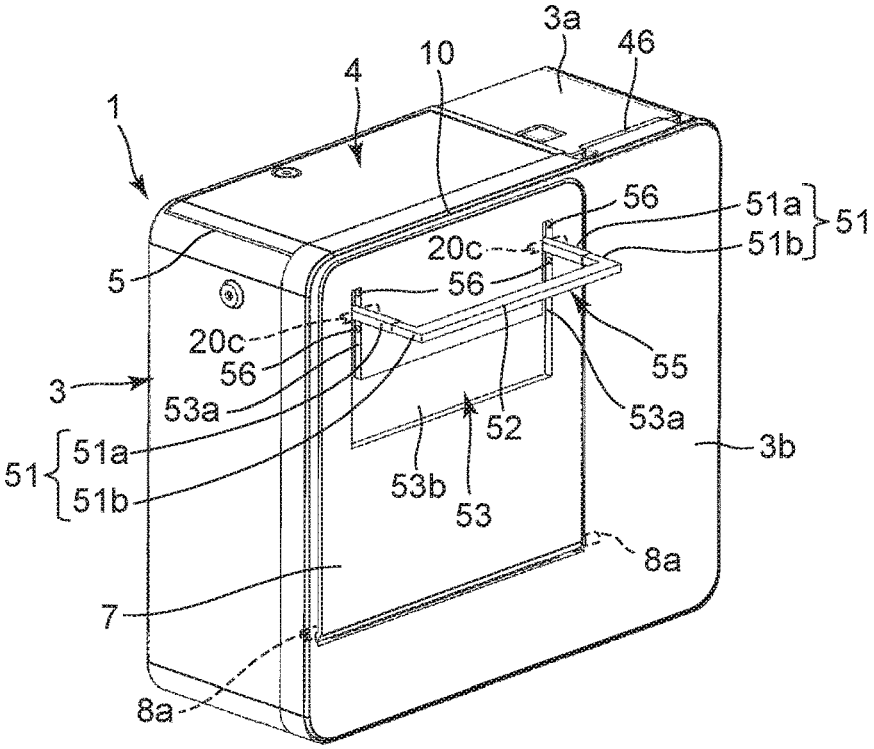

Also, a stand 55 of the second modification example shown in FIG. 14B has the same structure as that of the stand 50 of the first modification example except that the attachment position to the open/close cover 7 is adjustable. That is, each arm housing section 53*a* of the stand storage section 53 for storing the stand 55 has a plurality of attachment holes 56 which are provided along the arm housing section 53*a* and to which the corresponding attachment shaft 20*c* of the fixed arms 51*a* of the arm sections 51 is attached.

With this stand 55, when the cover opening section 10 of the housing 3 in the vertical orientation state is exposed by the open/close cover 7 being rotated to the front side so as to be in the laterally inclined state, the pair of arm sections 51 comes out of the stand storage section 53 by their self-weight so that the connection section 52 is arranged on the placement surface T such as a table.

Here, if an obstacle is present on the placement surface T such as a table, the attachment positions of the attachment shafts 20*c* on the fixed arms 51*a* of the pair of arm sections 51 can be adjusted by switching from the current attachment holes 56 for attaching the attachment shafts 20*c* to other holes 56. Accordingly, even if an obstacle is present on the placement surface T such as a table, the open/close cover 7 can be favorably supported by the stand 55 with it being substantially horizontal to the placement surface T.

Also, with this stand 55, by the current attachment holes 56 for attaching the attachment shafts 20*c* on the fixed arms 51*a* of the pair of arm sections 51 being switched to other holes 56 so that the cash storage apparatus 1 is used with the open/close cover 7 being inclined upward with respect to the placement surface T such as a table, the installation space can be further narrowed.

Also, in the above-described embodiment, the open/close cover 7 is provided such that it is positioned on the upper surface 3*b* of the housing 3 when the housing 3 is in the horizontal orientation state. However, the present invention is not limited thereto, and a structure may be adopted in which the open/close cover 7 is provided such that it is positioned on the undersurface of the housing 3 when the housing 3 is in the horizontal orientation state.

Moreover, in the above-described embodiment, the intermediate wheel 36 which is rotated by the motor 34, the first rotator 37, and the second rotator 38 in the open/close mechanism. 23 are gear wheels. However, the present invention is not limited thereto, and a structure may be adopted in which the intermediate wheel, the first rotator, and the second rotator are constituted by pulleys and the rotation of the intermediate wheel is transmitted to the first rotator and the second rotator via a belt.

Still further, in the above-described embodiment, the open/close mechanism 23 is structured to include the intermediate wheel 36 which is rotated by the motor 34, the first rotator 37, and the second rotator 38. However, the present invention is not limited thereto, and a structure may be adopted in which one rotator which is rotated forward or backward by the motor 34 is provided and the first cam pin 40 and the second cam pin 41 are provided to this rotator.

While the present invention has been described with reference to the preferred embodiments, it is intended that the invention be not limited by any of the details of the description therein but includes all the embodiments which fall within the scope of the appended claims.

What is claimed is:

1. A cash storage apparatus comprising:

a cash storage case; and a housing comprising:

a first surface and a second surface substantially parallel to the first surface; and a third surface and a fourth surface substantially parallel to the third surface, wherein in a horizontal orientation state of the housing relative to a placement surface on which the housing is placed, the first surface faces a front direction relative to the placement surface, the second surface faces a back direction relative to the placement surface, the third surface faces an upward direction relative to the placement surface and the fourth surface faces a downward direction relative to the placement surface:

the cash storage case is configured to be pulled out or pushed out away from the first surface of the housing in the front direction; and a depth of the housing between the first surface and the second surface is greater than a height of the housing between the third surface and the fourth surface, and where the housing is rotated and turned to be in a vertical orientation state of the housing relative to the placement surface, such that the first surface faces the upward direction, the second surface faces the downward direction, the third surface faces the front direction, the fourth surface faces the back direction, a first portion of the third surface forms an open/close cover configured to be moved in the front direction away from a second portion of the third surface to an open position to expose the cash storage case arranged within the housing and to be moved in the back direction toward the second portion of the third surface to a closed position.

2. The cash storage apparatus according to claim 1, wherein the open/close cover comprises a shaft positioned closer to the second surface than to the first surface, and wherein the open/close cover is configured to rotate around the shaft between the open position and the closed position.

3. The cash storage apparatus according to claim 2, wherein the first surface defines a receipt ejection slot configured to guide a receipt being ejected from an interior of the housing to an exterior of the housing.

4. The cash storage apparatus according to claim 3, further comprising a printer arranged within the housing, wherein the printer is configured to print information on a surface of the receipt and to eject the receipt having the information printed on the surface of the receipt through the receipt ejection slot from the interior of the housing to the exterior of the housing.

5. A cash storage apparatus comprising:

a cash storage case;

a printer; and a housing comprising:

a first surface and a second surface substantially parallel to the first surface; and a third surface and a fourth surface substantially parallel to the third surface, wherein in a horizontal orientation state of the housing relative to a placement surface on which the housing is placed, the first surface faces a front direction relative to the placement surface, the second surface faces a back direction relative to the placement surface, the third surface faces an upward direction relative to the placement surface and the fourth surface faces a downward direction relative to the placement surface:

the cash storage case is configured to be pulled out or pushed out away from the first surface of the housing in the front direction; and a depth of the housing between the first surface and the second surface is greater than a height of the housing between the third surface and the fourth surface, where the housing is rotated and turned to be in a vertical orientation state of the housing relative to the placement surface, such that the first surface faces the upward direction, the second surface faces the downward direction, the third surface faces the front direction and the fourth surface faces the back direction:

a first portion of the third surface forms an open/close cover configured to be moved in the front direction away from a second portion of the third surface to an open position to expose the cash storage case and to be moved in the back direction toward the second portion of the third surface to a closed position, wherein the first surface defines a receipt ejection slot configured to guide a receipt being ejected from an interior of the housing to an exterior of the housing, wherein in the horizontal orientation state of the housing, the printer is arranged within the housing and configured to print information on a surface of the receipt and to eject the receipt through the receipt ejection slot to have the printed information oriented in the upward direction, and wherein in the vertical orientation state of the housing, the printer is configured to eject the receipt through the receipt ejection slot to have the printed information oriented in the forward direction.

6. The cash storage apparatus according to claim 5, wherein the open/close cover comprises a shaft positioned closer to the second surface than to the first surface, and wherein the open/close cover is configured to rotate around the shaft between the open position and the closed position.

7. A cash storage apparatus comprising:

a cash storage case;

a housing comprising:

a first surface and a second surface substantially parallel to the first surface; and a third surface and a fourth surface substantially parallel to the third surface, wherein in a horizontal orientation state of the housing relative to a placement surface on which the housing is placed, the first surface faces a front direction relative to the placement surface, the second surface faces a back direction relative to the placement surface, the third surface faces an upward direction relative to the placement surface and the fourth surface faces a downward direction relative to the placement surface:

the cash storage case is configured to be pulled out or pushed out away from the first surface of the housing in the front direction; and a depth of the housing between the first surface and the second surface is greater than a height of the housing between the third surface and the fourth surface; and one or more legs arranged to the second surface of the housing, and where the housing is rotated and turned to be in a vertical orientation state of the housing relative to the placement surface, such that the first surface faces the upward direction, the second surface faces the downward direction, the third surface faces the front direction and the fourth surface faces the back direction, the one or more legs are configured to support the housing on the placement surface.

8. The cash storage apparatus according to claim 7, wherein the first surface, the second surface, the third surface and the fourth surface are configured such that in the vertical orientation state of the housing, a first portion of the third surface forms an open/close cover configured to be moved in the front direction away from a second portion of the third surface to an open position to expose the cash storage case and to be moved in the back direction toward the second portion of the third surface to a closed position.

9. The cash storage apparatus according to claim 8, wherein the open/close cover comprises a shaft positioned closer to the second surface than to the first surface, and wherein the open/close cover is configured to rotate around the shaft between the open position and the closed position.

10. The cash storage apparatus according to claim 8, further comprising a printer arranged within the housing, wherein the first surface defines a receipt ejection slot configured to guide a receipt being ejected from an interior of the housing to an exterior of the housing, and wherein the printer is configured to print information on a surface of the receipt and to eject the receipt having the information printed on the surface of the receipt through the receipt ejection slot from the interior of the housing to the exterior of the housing such that:

in the horizontal orientation state, the receipt is ejected with the printed information oriented in the upward direction; and in the vertical orientation state, the receipt is ejected with the printed information oriented in the front direction.

* * * * *